US006158970A

United States Patent [19]

Ota et al.

[11] Patent Number: 6,158,970

[45] Date of Patent: Dec. 12, 2000

[54] VARIABLE DISPLACEMENT COMPRESSOR

[75] Inventors: Masaki Ota; Taku Adaniya; Kenta Nishimura; Hirotaka Kurakake; Osamu Hiramatsu; Hisakazu Kobayashi; Yasunori Makino; Ken Suitou; Kenji Takenaka, all of Kariya, Japan

[73] Assignee: Kabushiki Kaisha Toyoda Jidoshokki Seisakusho, Kariya, Japan

[21] Appl. No.: 09/280,115

[22] Filed: Mar. 26, 1999

[30] Foreign Application Priority Data

Mar. 31, 1998 [JP] Japan ..... 10-086059
Jul. 10, 1998 [JP] Japan ..... 10-196231

[51] Int. Cl.[7] ..... F04B 1/26

[52] U.S. Cl. ..... 417/222.2; 417/270; 137/50

[58] Field of Search ..... 417/222.2, 270; 137/50, 57

[56] References Cited

U.S. PATENT DOCUMENTS 4,872,814 10/1989 Skinner et al. ..... 417/222
5,547,346 8/1996 Kanzaki et al. ..... 417/222.2
6,010,314 1/2000 Kobayashi et al. ..... 417/222.2
6,015,269 1/2000 Ota et al. ..... 417/222.2
6,056,513 5/2000 Kawaguchi et al. ..... 417/222.1

*Primary Examiner*—Charles G. Freay
*Assistant Examiner*—Robert Evora
*Attorney, Agent, or Firm*—Morgan & Finnegan, L.L.P.

[57] ABSTRACT

A variable displacement compressor that decreases displacement to reduce compression load without imbalancing the rotation of the drive shaft when the rotating speed of the compressor's drive shaft exceeds a predetermined limit value. The compressor includes a pressurizing passage connecting a crank chamber to a discharge chamber. A rotated guide rotates integrally with the drive shaft. The pressurizing passage is opened and closed by a valve body. Orbiting balls, which contact the valve body, are arranged about the axis of the drive shaft and the rotated guide. The balls follow the rotation of the rotated guide and orbit about the axis. The orbiting radius of the balls varies. A spring urges the balls in a direction decreasing the orbiting radius of the balls. When the rotating speed of the drive shaft exceeds the limit value, centrifugal force moves the balls against the force of the spring and increases the orbiting diameter of the balls. This moves the valve body and increases the size of the pressurizing passage.

20 Claims, 14 Drawing Sheets

VARIABLE DISPLACEMENT COMPRESSOR

BACKGROUND OF THE INVENTION

The present invention relates to variable displacement compressors suitable for automotive air conditioning systems.

Typically, variable displacement compressors are employed in automotive air conditioning systems. A typical variable displacement compressor has a housing that houses a crank chamber and supports a rotatable driving shaft. Cylinder bores extend through a cylinder block, which forms part of the housing. A piston is accommodated in each cylinder bore. A cam plate is supported to rotate integrally with the drive shaft, while inclining in the axial direction. The peripheral portion of the cam plate is connected to each piston. A displacement control valve adjusts the difference between the pressure of the crank chamber and the pressure acting on the pistons in the cylinder bores (hereafter referred to as the first differential pressure ΔP1). The inclination of the cam plate with respect to a plane perpendicular to the drive shaft is altered in accordance with the first differential pressure ΔP1 to vary the displacement of the compressor.

Typically, the variable displacement compressor is connected to an automotive engine by an electromagnetic clutch. The clutch is actuated to connect the engine to the compressor when activating the air conditioning system.

When the cam plate is arranged at a maximum inclination position to maximize displacement, a rise in the engine speed may rotate the drive shaft at a high speed. In such case, the compression load increases in a sudden manner. This increases the product of the pressure between contacting surfaces of moving parts and the velocity of the contacting moving parts (i.e., Pv value). As a result, the life of the moving parts and the compressor is shortened.

Such shortcomings have been overcome by de-actuating the electromagnetic clutch to stop operation of the compressor when the acceleration pedal is depressed to increase the engine speed and accelerate the vehicle. The electromagnetic clutch is de-actuated when parameters such as the engine speed, the intake air pressure, and the depression angle of the acceleration pedal, indicate acceleration. However, this increases fluctuations in the temperature of the air passing through an evaporator. As a result, warm air enters the passenger compartment, which may make the passenger compartment uncomfortable during acceleration. Additionally, the shifting of the electromagnetic clutch between actuated and de-actuated states produces torque shocks.

There are also vehicles that continue operation of the compressor during acceleration. However, this interferes with acceleration and lowers fuel efficiency.

Accordingly, U.S. Pat. No. 4,872,814 proposes a variable displacement compressor that overcomes these shortcomings. The structure of this compressor is similar to the compressor that employs the cam plate but has a mechanism that shifts the displacement from maximum to minimum when the rotating speed becomes too high. As shown in FIG. 22 herein, the displacement shifting mechanism includes a pressurizing passage 101 that connects a crank chamber with a discharge pressure region (e.g., discharge chamber). The pressurizing passage 101 has a port 104. A valve body 102 is arranged on the drive shaft 103 to rotate integrally with the drive shaft 103. The valve body 102 further moves relative to the drive shaft in a direction parallel to and perpendicular to the axis L of the drive shaft 103. Movement in these two directions causes the valve body 102 to open or close the port 104. Under normal conditions, the forces of the springs 105, 106 cause the valve body 102 to close the port 104.

The valve body 102 includes a weight 102*a*. If the engine speed N increases and causes the rotating speed of the drive shaft 103 to exceed a predetermined limit value Nc when the displacement of the compressor is large, centrifugal force is applied to the weight 102*a*, which rotates integrally with the drive shaft 103. This moves the valve body 102 in a radial direction to the axis L against the force of the spring 105 and opens the port 104. When the port 104 is opened, the pressure of the discharge pressure region is communicated to the crank chamber through the pressurizing passage 101. This increases the pressure of the crank chamber. Consequently, the first differential pressure ΔP1 increases and decreases the displacement. Since this reduces the compression load, the application of excessive load on parts subject to friction is avoided.

If cooling of the condenser is insufficient when the displacement of the compressor is large, the pressure of the discharge pressure region becomes abnormally high. In such case, the pressure of the discharge pressure region that is communicated through the port 104 moves the valve body 102 in a direction parallel to axis L against the force of the spring 106 and opens the port 104. This communicates the pressure of the discharge pressure region to the crank chamber through the pressurizing passage 101 and increases the pressure of the crank chamber. As a result, the displacement decreases and reduces the compression load. This avoids the application of excessive load on parts subject to friction.

FIG. 23 is a graph illustrating the characteristics of the compressor of the '814 patent. Zone 109 (slanted lines) represents the range in which the rotating speed N exceeds the predetermined rotating speed limit value Nc of the drive shaft 103 (depicted by solid line 107) or in which the difference between the pressure of the discharge pressure region acting on the valve body 102 and the pressure of the crank pressure region (hereafter referred to as second differential pressure ΔP2) exceeds a predetermined limit value ΔPc (depicted by solid line 108). That is, zone 109 indicates the range in which the displacement is forcibly decreased to reduce the compression load of the compressor (regardless of the demand for cooling).

However, the compressor of the '814 patent also has several shortcomings. First of all, the valve body 102, which functions as a centrifugal valve, causes imbalanced rotation of the drive shaft 103. Imbalanced rotation of the drive shaft 103 may hinder compression motion. This increases torque fluctuation and degrades the driving comfort of the vehicle.

In addition, the displacement is not decreased unless either the drive shaft rotating speed N exceeds the predetermined limit value Nc or the second differential pressure ΔP2 exceeds the predetermined limit value ΔPc, even if the rotating speed N and the second differential pressure ΔP2 are both close to the associated limit values Nc, ΔPc. Therefore, to avoid excessive wear of moving parts caused by friction, conditions such as those represented by a corner zone S (indicated by crossed lines), in which the rotating speed N and the second differential pressure ΔP2 are both close to their limit values Nc, ΔPc must be avoided by lowering the limit values Nc, ΔPc, as depicted by broken lines 107, 108 in FIG. 23. However, this would lead to overprotection of the moving parts, especially when one of the lowered limit values Nc, ΔPc is exceeded, but the conditions are still outside the corner zone S. In such state, demands for cooling cannot be fulfilled in a satisfactory manner.

SUMMARY OF THE INVENTION

Accordingly, it is an objective of the present invention to provide a variable displacement compressor that decreases displacement to reduce compression load when the rotating speed of the drive shaft exceeds a predetermined limit value and properly balances rotation of the drive shaft.

To achieve the above objectives, the present invention provides a variable displacement compressor including a drive shaft rotated about its axis, a compression mechanism for drawing in and compressing gas in accordance with the rotation of the drive shaft, and a crank chamber housing part of the compression mechanism. The gas flows into and out of the crank chamber to vary the displacement in accordance with the pressure of the gas in the crank chamber. The compressor further includes a suction pressure region, which is exposed to the pressure of gas drawn into the compressor by the compression mechanism, a discharge pressure region, which is exposed to the pressure of gas compressed by the compression mechanism, a communication passage for connecting the discharge pressure region and the crank chamber, and a valve arranged in either the first passage or the second passage. The communication passage includes at least either a first passage or a second passage. The first passage increases the pressure of the crank chamber by permitting the flow of the gas from the discharge pressure region to the crank chamber. The second passage decreases the pressure of the crank chamber by permitting the flow of the gas from the crank chamber to the suction pressure region. The valve adjusts the opened area of the first or second passage to increase the pressure of the crank chamber when the rotating speed of the drive shaft exceeds a predetermined value. Furthermore, the valve includes a valve body for selectively opening and closing the first or second passage and orbiting elements, which follow the rotation of the drive shaft to orbit about the drive shaft and act on the valve body to selectively open and close the first or second passage. The orbiting elements maintain substantially equal angular intervals between one another when orbiting about the drive shaft. Each orbiting element has an orbiting radius defined by the path of the orbiting elements about the axis of the drive shaft. The orbiting elements move radially to change the orbiting radius in accordance with the rotating speed of the drive shaft.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
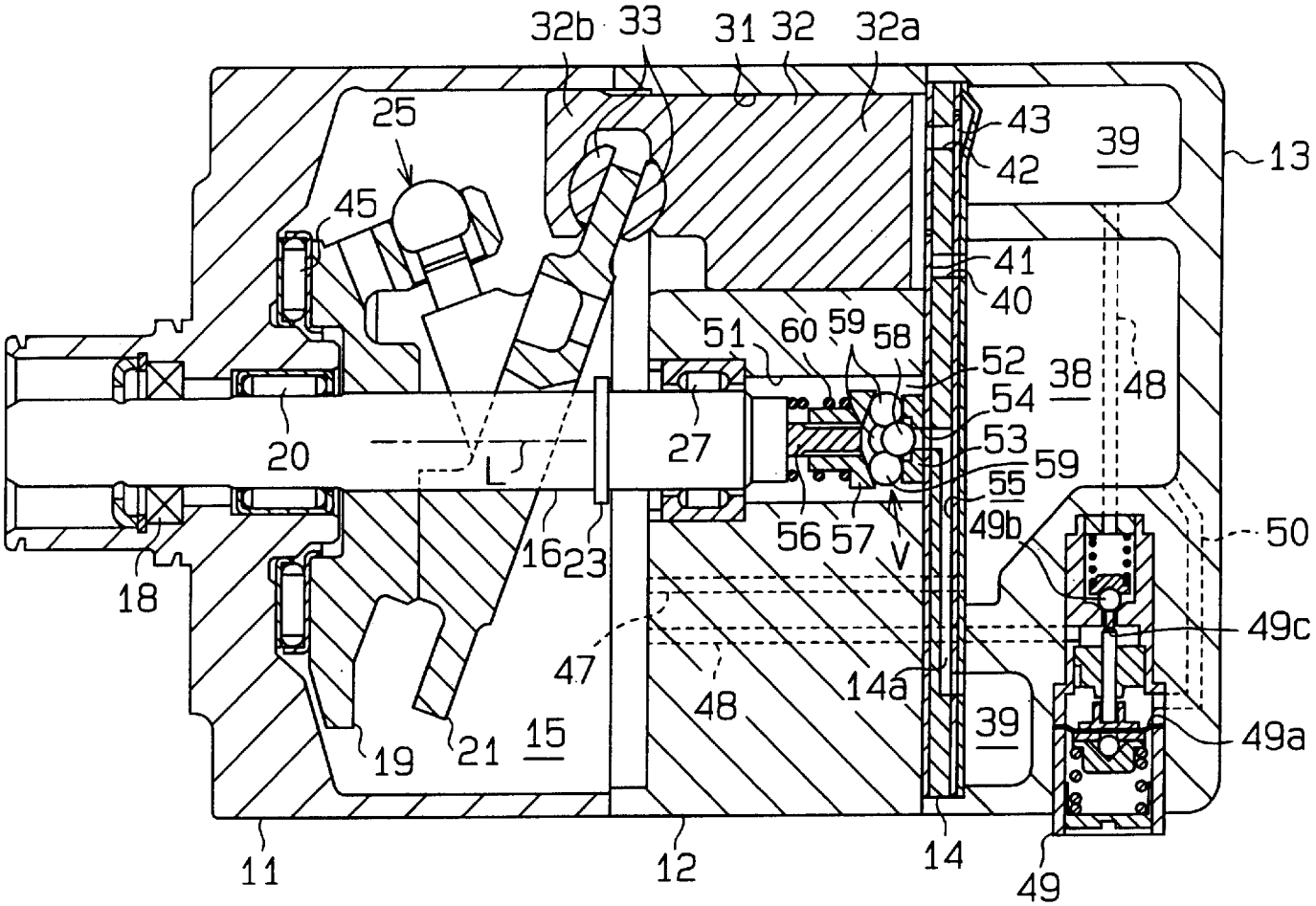
FIG. 1 is a cross-sectional view showing a compressor according to a first embodiment of the present invention.

A variable displacement compressor according to first to eleventh embodiments of the present invention will now be described. The compressor is employed in an automotive air-conditioning system. To avoid a redundant description in the second to eleventh embodiments, like or same reference numerals are given to those components which are the same as the corresponding components of the first embodiment.

(First Embodiment)

As shown in FIG. 1, a front housing 11 is fixed to the front end of a cylinder block 12, while a rear housing 13 is fixed to the rear end of the cylinder block 12 with a valve plate 14 arranged in between. A compressor housing is defined by the front housing 11, the cylinder block 12, and the rear housing 13.

The rear housing 13 houses a suction chamber 38, which defines a suction pressure region, and a discharge chamber 39, which defines a discharge pressure region. The valve plate 14 includes suction ports 40, suction flaps 41, discharge ports 42, and discharge flaps 43. A crank chamber 15 is defined in the front housing 11 in front of the cylinder block 12. A drive shaft 16 extends through the crank chamber 15 between the front housing 11 and the cylinder block 12. The drive shaft 16 is rotatably supported by radial bearings 20 and 21.

A rotor 19 is fixed to the drive shaft 16. A swash plate 21, which functions as a cam plate, is fitted to the drive shaft 16. The swash plate 21 is supported such that it inclines as it slides along the drive shaft 16. A hinge mechanism 25 connects the swash plate 21 to the rotor 19. Thus, the hinge mechanism 25 rotates the swash plate 21 integrally with the drive shaft 16 while guiding the inclining motion of the swash plate 21.

When the central portion of the swash plate 21 moves toward the cylinder block 12, the inclination of the swash plate 21, relative to a plane perpendicular to the axis L of the drive shaft, decreases. A snap ring 23 is fitted on the drive shaft 16 between the swash plate 21 and the cylinder block 12. Abutment of the swash plate 21 against the snap ring 23 restricts further inclination of the swash plate 21. In this state, the swash plate 21 is located at a minimum inclination position. An increase in the inclination of the swash plate 21 is permitted until the swash plate 21 abuts against the rotor 19. In this state, the swash plate 21 is located at a maximum inclination position.

Cylinder bores 31 extend through the cylinder block 12. A piston 32 is accommodated in each cylinder bore. Each piston 32 has a head 32*a* and an opposing skirt 32*b*. Each skirt 32*b* is coupled to the peripheral portion of the swash plate 21 by a pair of shoes 33. A compression reaction force produced by the compression motion of the pistons 32 is received by the front housing 11 by way of the shoes 33, the swash plate 21, the hinge mechanism 25, the rotor 19, and a thrust bearing 45.

A bleeding passage 47 extends between the crank chamber 15 and the suction chamber 38 through the cylinder block 12 and the valve plate 14. The bleeding passage 47 is located between a pair of adjacent cylinder bores 31.

An adjustment passage 48 and a pressurizing passage 55 independently connect the discharge chamber 39 and the crank chamber 15. A displacement control valve 49 is arranged in the adjustment passage 48. The control valve 49 has a diaphragm 49*a*, a valve body 49*b*, and a valve hole 49*c*. The diaphragm 49*a* adjusts the opening size of the valve hole 49*c* by regulating the position of the valve body 49*b*. Suction pressure Ps is communicated through a pressure sensing passage 50 and is applied to the diaphragm 49*a* to adjust the opening size of the valve hole 49*c* with the valve body 49*b*.

The control valve 49 adjusts the amount of refrigerant gas drawn into the crank chamber 15 from the discharge chamber 39 through the adjustment passage 48 to control the first differential pressure ΔP1, which is the difference between the crank chamber pressure Pc acting on the skirt side of the pistons 32, and the pressure Pd of the cylinder bores 31 acting on the head side of the pistons 32. The inclination of the swash plate 21 is varied in accordance with the first differential pressure ΔP1. This changes the stroke of the pistons 32 and varies the displacement.

As shown in FIGS. 1 to 4, a central bore 51 extends through the cylinder block 12. A conduit 14*a* extends through the valve plate 14 between the discharge chamber 39 and the central bore 51. The pressurizing passage 55 includes the conduit 14*a*, the central bore 51, and the spaces formed in the radial bearing 27. The high-pressure refrigerant gas in the discharge chamber 39 is sent into the crank chamber 15 through the pressurizing passage 55 to increase the crank chamber pressure Pc. This increases the first differential pressure ΔP1 and decreases the displacement.

A valve chamber 52 is defined in the central bore 51. A valve V is accommodated in the valve chamber 52 to selectively open and close the pressurizing passage 55. The valve V opens the pressurizing passage 55 when the rotating speed N of the drive shaft 16 exceeds a predetermined limit value Nc and closes the pressurizing passage 55 when the speed N is equal to or lower than the limit value Nc.

The valve V includes a valve seat 53, which serves as a fixed guide. The valve seat 53 is fixed to the valve plate 14 in the valve chamber 52. A valve chamber port 54, which is aligned with the drive shaft axis L, extends through the valve seat 53. The valve chamber 52 is connected to the discharge chamber 39 through the valve chamber port 54 and the conduit 14*a*.

The valve seat 53 has a fixed guide surface 53*a*, which faces a rear end face 16*a* of the drive shaft 16. The fixed guide surface 53*a* is flat and annular. The valve chamber port 54 extends through the center of the fixed guide surface 53*a*. The inner portion of the fixed guide surface 53*a* is stepped toward the valve plate 14.

A connecting rod 56 projects from the rear end face 16*a* of the drive shaft 16 along the axis L. The connecting rod 56 is coupled to a guide 57, which serves as a rotating member by axially extending splines 56*a*, 57*b* such that the guide 57 rotates integrally with the drive shaft 16 while permitting axial movement of the guide 57. The guide 57 has a rotated guide surface 57*a* coaxial to the fixed guide surface 53*a* of the valve seat 53. The rotated guide surface 57*a* is tapered like the surface of a truncated cone. The greater the radius of a point on the rotated guide surface 57*a*, the closer that point is to the fixed guide surface 53*a*.

A spherical valve body 58 is accommodated in the valve chamber 52. The valve body 58 moves along axis L to open or close the valve chamber port 54. That is, the valve body 58 opens or closes the pressurizing passage 55 in the valve chamber 52, which is included in the crank chamber pressure region. A plurality of equally spaced orbiting elements, or orbiting balls 59, are arranged between the fixed guide surface 53*a* and the rotated guide surface 57*a*. The centers of the balls 59 are located on a circle, the center of which is the axis L. The angular spacing between any given ball 59 and the ball 59 furthest from the given ball 59 is 90° or greater. The balls 59 and the valve body 58 are identical. Thus, the diameter and material of the balls 59 and the valve body 58 are the same.

A coil spring 60 is arranged between the rear end face 16*a* of the drive shaft 16 and a stepped portion 57*c* of the rotated guide 57 to urge the rotated guide 57 toward the valve seat 53. Thus, the balls 59 are held between the planar fixed guide surface 53*a* and the conical rotated guide surface 57*a*. The conical rotated guide surface 57*a* forces the balls 59 toward axis L until the balls 59 contact the valve body 58. Thus, pressure is applied to the outer surface of the valve body 58 from several locations by the balls 59. The pressure is directed toward the center point O1 of the valve body 58. The center point ol is located along axis L at a position that is rearward from contact points O2, which are the points of contact between the balls 59 and the valve body 58. Thus, the valve body 58 is urged to abut against the valve seat 53 to close the valve chamber port 54.

The operation of the compressor will now be described. The drive shaft 16 is rotated by an external drive source such as an automotive engine. When the drive shaft 16 is rotated, the rotor 19 and the hinge mechanism 25 rotate the swash plate 21 integrally with the drive shaft 16. The rotation of the swash plate 21 is converted to linear reciprocation of the pistons 32 by means of the shoes 33. The reciprocation of each piston 32 causes the refrigerant gas in the suction chamber 38 to be drawn into the associated cylinder bore 31 through the suction port 40 and suction flap 41. The refrigerant gas is then compressed to a predetermined pressure value and discharged from the cylinder bore 31 into the discharge chamber 39 through the discharge port 42 and the discharge flap 43.

When the compressor is not operating, the pressures of the suction chamber 38, the discharge chamber 39, and the crank chamber 15 are substantially balanced. In this state, the valve hole 49*c* is closed by the valve body 49*b* in the control valve 49. When commencing operation of the compressor, the reciprocation of the pistons 32 compresses refrigerant gas and discharges the compressed gas into the discharge chamber 39.

The cooling load is great when the temperature in the passenger compartment is high. In such state, the suction pressure Ps in the suction chamber 38 is high. Thus, the first differential pressure ΔP1 (the difference between the pressure Pc of the crank chamber 15 and the pressure Pb of the cylinder bores 31) is small. This holds the swash plate 21 at the maximum inclination position, as shown in FIG. 1, and lengthens the stroke of the pistons 32 to operate the compressor at its maximum displacement. In this state, the high suction pressure Ps communicated through the pressure sensing passage 50 acts on the diaphragm 49*a* and keeps the valve hole 49*c* closed by the valve body 49*b*. Thus, the adjustment passage 48 is closed. The high-pressure refrigerant gas in the discharge chamber 39 therefore does not flow into the crank chamber 15.

During the compression and discharge stroke of each piston 32, in which the piston 32 moves from the bottom dead center position to the top dead center position, blow-by gas flows into the crank chamber 15 through the space between the outer surface of the piston 32 and the wall of the associated cylinder bore 31. The blow-by gas in the crank chamber 15 is returned to the suction chamber 38 through the bleeding passage 47. Thus, the crank chamber pressure Pc is maintained at a satisfactory level regardless of the blow-by gas and enables the compressor to continue operation in the maximum displacement state.

When the temperature of the passenger compartment decreases, the cooling load decreases. This decreases the suction pressure Ps of the suction chamber 38. The low suction pressure Ps communicated through the pressure sensing passage 50 acts on the diaphragm 49*a* of the control valve 49. Thus, the diaphragm 49*a* deforms in accordance with the suction pressure Ps. This moves the valve body 49*b* in a direction opening the valve hole 49*c*, which increases the size of the adjustment passage 48. Hence, the high-pressure refrigerant gas in the discharge chamber 39 flows into the crank chamber 15 through the adjustment passage 48. The flow rate of the refrigerant gas sent to the crank chamber 15 changes in accordance with the size of the valve hole 49*c*. As a result, the pressure Pc of the crank chamber 15 increases thereby increasing the first differential pressure ΔP1. The swash plate 21 moves toward the minimum inclination position in accordance with the first differential pressure ΔP1. This shortens the stroke of the pistons 32 and decreases the displacement.

Figure 2:
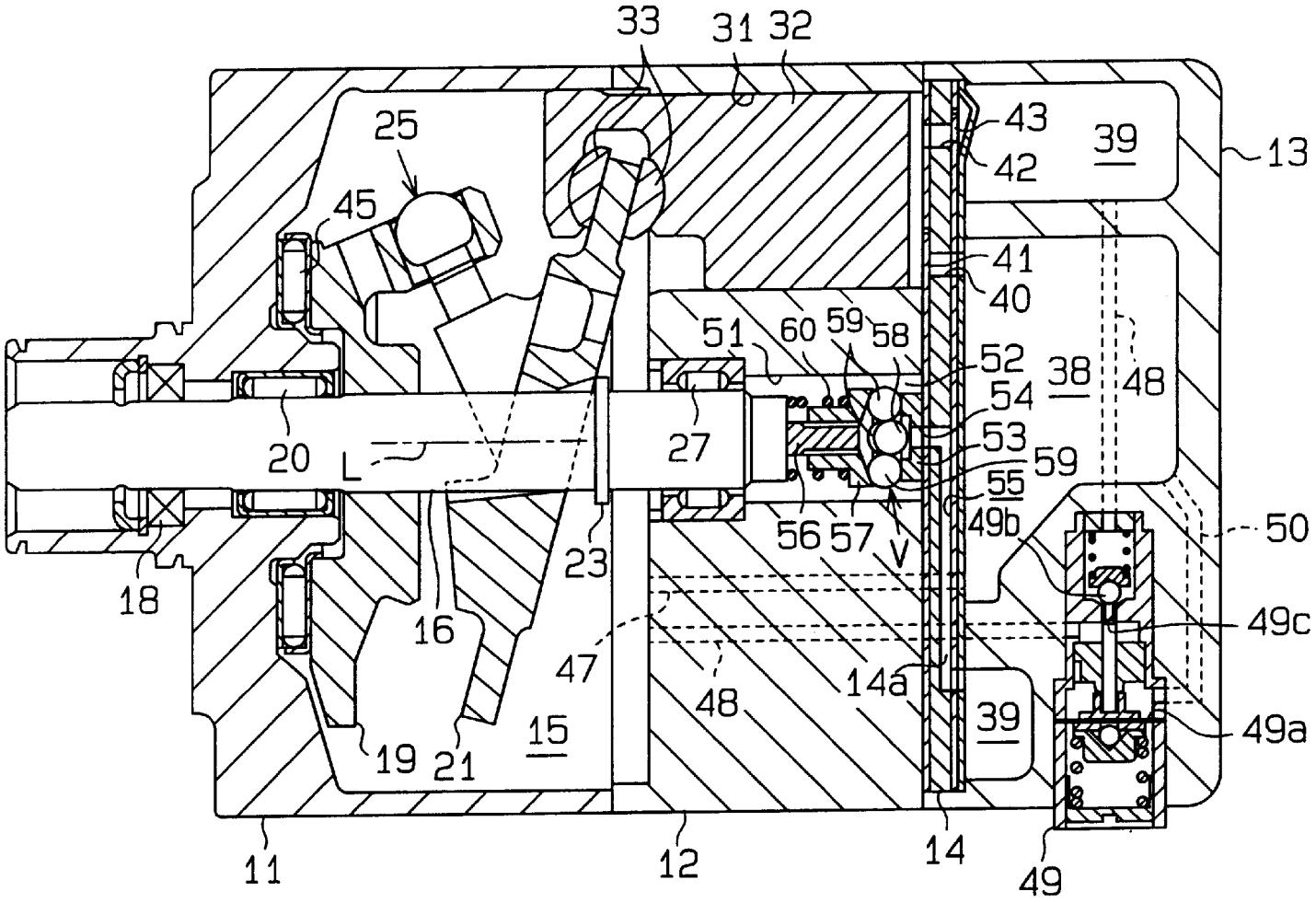
FIG. 2 is a cross-sectional view showing the compressor of FIG. 1 in a minimum displacement state.

When the temperature of the passenger compartment further decreases, the cooling load approaches a null state. This further decreases the suction pressure Ps of the suction chamber 38 and maximizes the size of the valve hole 49*c* of the control valve 49. In this state, the high-pressure refrigerant gas in the discharge chamber 39 is sent to the crank chamber 15 through the adjustment passage 48. This further increases the first differential pressure ΔP1 and moves the swash plate 21 to the minimum inclination position, as shown in the state of FIG. 2. This shortens the stroke of the pistons 32 and operates the compressor in a minimum displacement state.

During operation of the compressor, if the temperature of the passenger compartment increases, the cooling load increases. This increases the suction pressure Ps of the suction chamber 38. The increased suction pressure Ps communicated through the pressure sensing passage 50 acts on the diaphragm 49*a* of the control valve 49. Thus, the diaphragm 49*a* deforms in accordance with the suction pressure Ps. This moves the valve body 49*b* in a direction closing the valve hole 49*c* and causes the control valve 49 to decrease the size of the adjustment passage 48. Hence, the flow rate of the refrigerant gas sent to the crank chamber 15 from the discharge chamber 39 through the adjustment passage 48 decreases. As a result, the pressure Pc of the crank chamber 15 decreases thereby decreasing the first differential pressure ΔP1. The swash plate 21 moves toward the maximum inclination position in accordance with the first differential pressure ΔP1. This lengthens the stroke of the pistons 32 and increases the displacement.

When the temperature of the passenger compartment and the cooling load further increases, the suction pressure Ps of the suction chamber 38 increases. The high suction pressure Ps, communicated through the pressure sensing passage 50, acts on the diaphragm 49*a* of the control valve 49 and closes the valve hole 49*c*, or the adjustment passage 48. This stops the flow of high-pressure refrigerant gas from the discharge chamber 39 to the crank chamber 15. The refrigerant gas in the crank chamber 15 then bleeds into the suction passage 38 through the bleeding passage 47. This decreases the pressure Pc of the crank chamber 15 such that the difference with the suction pressure Ps in the suction chamber 38 becomes small. Thus, the first differential pressure ΔP1 becomes small and moves the swash plate 21 to the maximum inclination position. This lengthens the stroke of the pistons 32 and operates the compressor in a maximum displacement state.

Accordingly, the variable displacement compressor alters the pressure Pc of the crank chamber 15 with the control valve 49 in accordance with the cooling load, or suction pressure Ps, to ultimately maintain the suction pressure Ps at a constant suction pressure Ps.

Figure 3:
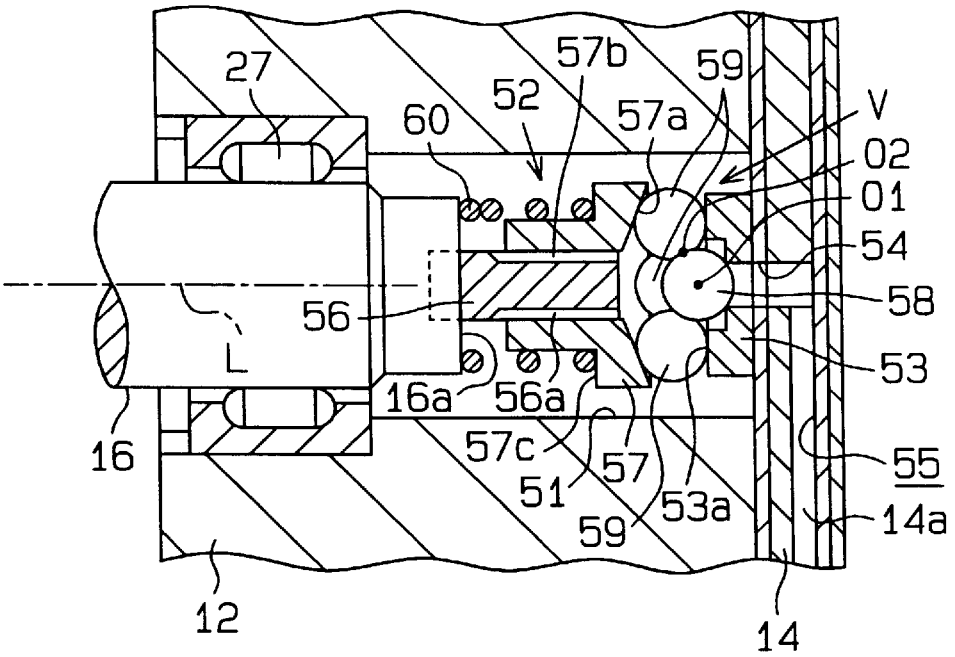
FIG. 3 is a partial enlarged cross-sectional view showing the vicinity of a valve of the compressor of FIG. 1.

As shown in FIGS. 1 and 3, the valve body 58 of the valve V closes the valve chamber port 54 and the pressurizing passage 55 when the drive shaft 16 is rotated under normal conditions.

During operation of the compressor, the guide 57 rotates integrally with the drive shaft 16. Thus, the rotated guide surface 57*a* rotates relative to the fixed guide surface 53*a* of the seat 53. Since the balls 59 are held between the guide surfaces 53*a*, 57*a*, the rotation of the guide 57 rolls the balls 59 about the axis L of the drive shaft 16. Centrifugal force acts on the rolling balls 59 in a direction that increases the orbital radius of the balls 59.

If the rotating speed N of the drive shaft 16 is low, the centrifugal force applied to the balls 59 is small. In such case, the force of the coil spring 60 urges the balls 59 toward the drive shaft axis L. The balls 59 abut against the valve body 58. This restricts movement of the balls 59 toward axis L and stabilizes the rolling motion of the balls 59 about axis L.

The conical surface of the rotated guide surface 57*a* is tapered relative to axis L such as to counter the centrifugal force acting of the balls 59. Thus, the guide 57 receives a component force that urges the guide 57 in a direction countering the force of the spring 60 when centrifugal force acts on the balls 59. This offsets the force of the spring 60 and decreases the force applied to the valve body 58 that closes the valve chamber port 54 compared to that when the drive shaft 16 is stationary. The closing force decreases as the rotating speed of the drive shaft 16 increases.

As the operation of the compressor continues, the pressure of the discharge chamber 38 Pd becomes higher than the pressure Pc of the valve chamber 52, which is included in the crank pressure region. Accordingly, the difference between the pressure Pd of the discharge chamber 39 and the pressure Pc of the valve chamber 52, or the second differential pressure ΔP2, acts on the valve body 58 in a direction opening the valve chamber port 54 during operation of the compressor. The force becomes greater if the rotating speed N of the drive shaft 16 increases, which causes an increase in the pressure Pd of the discharge chamber 39, or if the pressure Pd of the discharge chamber 39 is increased by insufficient cooling by the condenser (not shown).

Accordingly, during operation of the compressor, the opening of the pressurizing passage 55 by the valve body 58 is determined in accordance with changes in the rotating speed N of the drive shaft 16 and the second differential pressure ΔP2. This is due to the changing equilibrium between the force that opens the valve chamber port 54 and the force that closes the valve chamber port 54.

Figure 6:
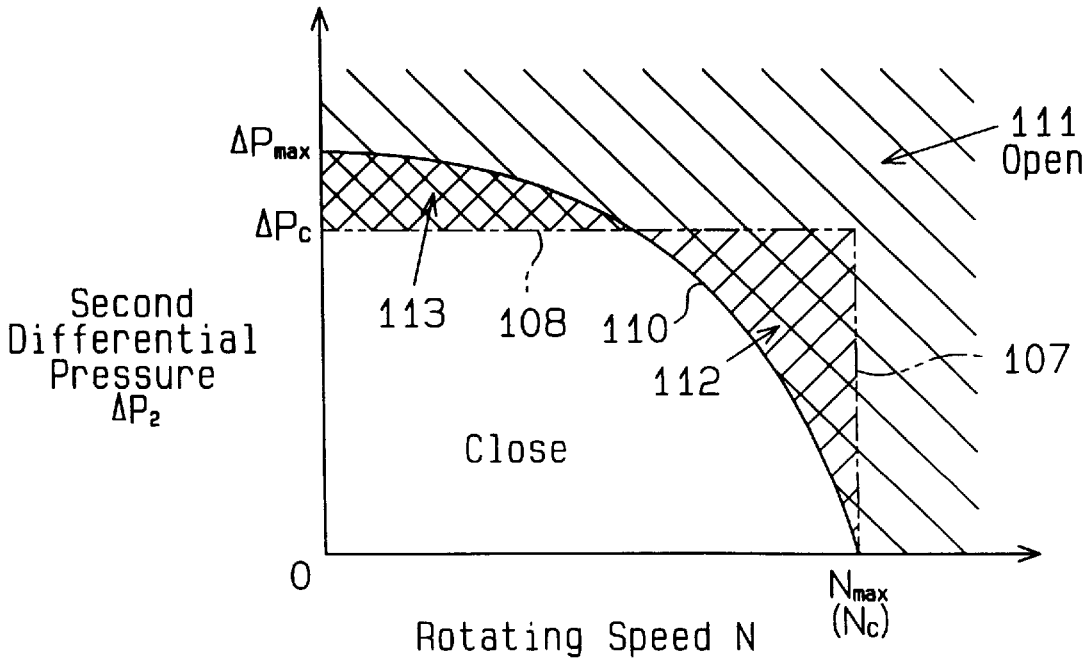
FIG. 6 is a graph showing the characteristics of the valve.

In other words, the level of the second differential pressure ΔP2 required to open the valve chamber port 54 decreases as the rotating speed of the drive shaft 16 becomes higher. On the other hand, the rotating speed N of the drive shaft 16 that causes the valve body 58 to open the valve chamber port 54 becomes lower as the second differential pressure ΔP2 increases (i.e., as the pressure of the discharge chamber 39 increases). FIG. 6 is a graph showing the characteristics of the valve V. The horizontal axis represents the rotating speed N, while the vertical axis represents the second differential pressure ΔP2. The second differential pressure ΔP2 that opens the valve V when the rotating speed N is null is defined as $\Delta P_{max}$, while the rotating speed N that opens the valve V when the second differential pressure ΔP2 is null is defined as $N_{max}$. Limit values for determining whether the valve body 58 should be opened are plotted along a limit value curve 110, which connects $\Delta P_{max}$ and $N_{max}$. Zone 111, indicated by slanted lines (which includes the area 112 marked by rectangles), represents the range in which the valve V is opened. The zone on the other side of the curve 110 (which includes the area 113 marked by squares) represents the range in which the valve V is closed.

When the valve body 58 opens the valve chamber port 54, gas from the discharge chamber 39 is drawn into the crank chamber 15 through the pressurizing passage 55. This increases the pressure of the crank chamber 15, increases the first differential pressure ΔP1, and decreases the displacement. The decreased displacement decreases the compression load of the compressor and avoids early deterioration of the moving parts, such as the bearings 20, 27, 45, the seal 18, the swash plate 21, the shoes 33, and the pistons 32.

Figure 4:
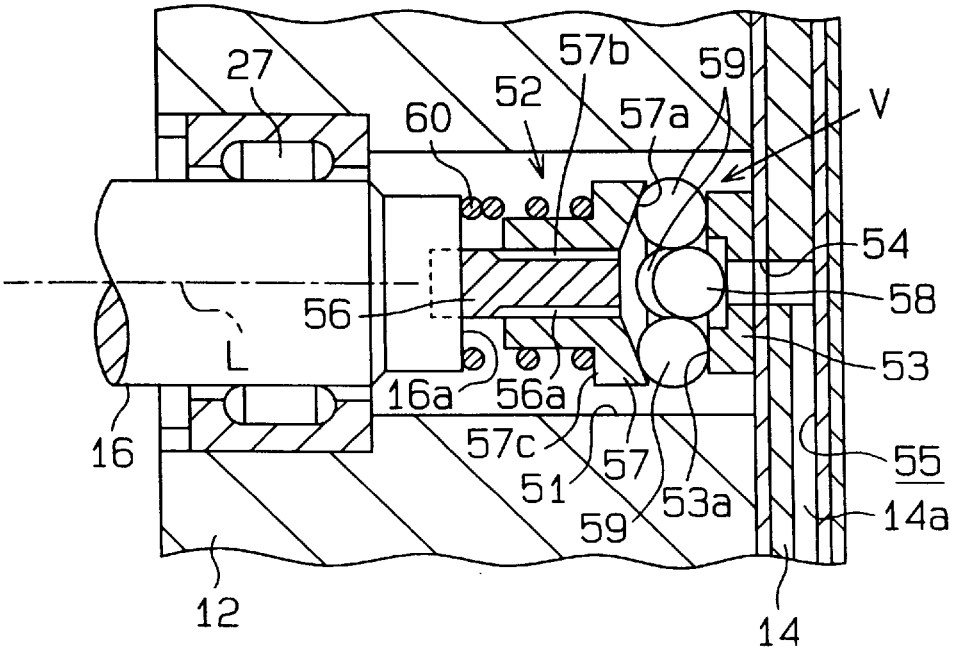
FIG. 4 is a partial enlarged cross-sectional view showing the operation of the valve.
Figure 5:
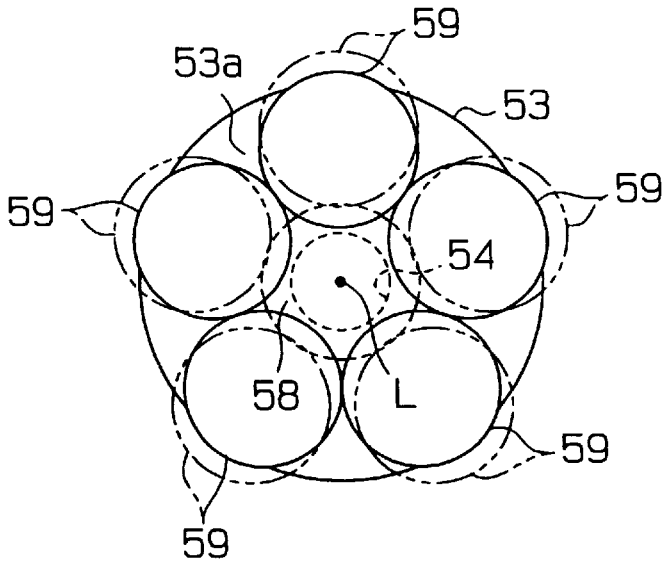
FIG. 5 is a front view showing the valve with the orbiting balls and valve body removed.

If the rotating speed N of the drive shaft 16 increases when the valve V is opened, such as in the state shown in FIG. 4, an increase in centrifugal force urges the balls 59 outward from the guide surfaces 53*a*, 57*a*. However, the wall of the central bore 51 restricts the orbiting radius of the balls 59. Thus, the balls 59 remain between the guide surfaces 53*a*, 57*a*.

When the rotating speed N of the drive shaft 16 and the second differential pressure ΔP2 fall below the limits set by the limit value curve 110 (FIG. 6) when the valve chamber port 54 is opened, the force applied to the valve body 58 in a direction opening the valve chamber port 54 becomes less than the force applied to the valve body 58 in a direction closing the valve chamber port 54. Accordingly, the force of the spring 60 moves the rotated guide 57 toward the seat 53 and narrows the distance between the guide surfaces 57*a*, 53*a*. This moves the balls 59 inward along the conical rotated guide surface 57*a* such that the orbiting radius of the balls 59 decreases and forces the valve body 58 toward the seat 53 to close the valve chamber port 54. When the valve chamber port 54 is closed, the delivery of gas from the discharge chamber 39 to the crank chamber 15 through the pressurizing passage 55 stops. In this state, displacement is varied by the control valve 49, which controls the size of the adjustment passage 48.

The advantages of the first embodiment will now be described.

(1) In the first embodiment, the valve V is arranged in the pressurizing passage 55, which connects the discharge chamber 39 and the crank chamber 15, to open the pressurizing passage 55 when the rotating speed N of the drive shaft 16 exceeds the limit defined by the limit value curve 110 of FIG. 6. If the rotating speed N exceeds the limit value when the displacement of the compressor is large, the valve V opens the pressurizing passage 55 to permit the flow of the high-pressure refrigerant gas in the discharge chamber 39 to the crank chamber 15, which increases the pressure of the crank chamber 15. This decreases the displacement of the compressor, reduces the compression load, and decreases the pressure applied to moving components that are subject to friction. As a result, the Pv value of the moving components decreases, which extends the life of the compressor.

(2) The valve V is arranged between the rear end of the drive shaft 16 and the valve plate 14. Thus, the valve V is arranged using the open space in the vicinity of the rear end of the drive shaft 16, or the central bore 51, efficiently. This avoids interference between the valve V and other compressor components. Furthermore, the compressor need not be enlarged to install the valve V.

(3) The balls 59, which receive centrifugal force during rotation of the drive shaft 16, are arranged about the axis L and equally spaced from one another. The balanced arrangement of the balls 59 permits smooth compression motion, eliminates vibration, and maintains the driving comfort of the vehicle.

(4) As shown by the limit value curve 110 in the graph of FIG. 6, the valve body 58 opens the valve chamber port 54 at a smaller second differential pressure ΔP2 as the drive shaft rotating speed N becomes higher. The valve body 58 opens the valve chamber port 54 at a lower drive shaft rotating speed N as the second differential pressure ΔP2 becomes higher. In the compressor of U.S. Pat. No. 4,872, 814, the limit value Nc of the drive shaft rotating speed N, at which the valve is opened, is constant, as depicted by vertical line 107. However, in this embodiment, the rotating speed N that determines the opening timing of the valve V in accordance with the second differential pressure ΔP2 varies as shown by the limit value curve 110. Furthermore, in the compressor of the '814 patent, the limit value ΔPc of the second differential pressure ΔP2, at which the valve is opened, is constant, as depicted by horizontal line 108. However, in this embodiment, the limit value of the second differential ΔP2 varies in accordance with the drive shaft rotating speed N.

Accordingly, the compressor is prevented from being operated in a large displacement state when the drive shaft rotating speed N and the discharge chamber pressure Pd are both high. In other words, if the second differential pressure ΔP2 and the drive shaft rotating speed N are included in triangular zone 112, as shown in the graph of FIG. 6, operation of the compressor is avoided.

Furthermore, in the prior art, the limit value ΔPc of the second differential pressure ΔP2 was required to be set at a low value even at low drive shaft rotating speeds N. However, in this embodiment, the second differential pressure ΔP2 at which the valve V opens is higher at lower rotating speeds N. Thus, if the point representing the second differential pressure ΔP2 and the rotating speed N is between the horizontal line 108 and the limit value curve 110, as shown in the graph of FIG. 6, the valve V is not opened. In other words, the valve V does not open when the second differential pressure ΔP2 is low. This prevents an unnecessary displacement decrease when the compressor is being driven at low speeds. Accordingly, the compressor responds appropriately to demands for cooling while protecting itself.

(5) The balls 59 roll in any direction. Thus, the balls 59 roll smoothly along the guide surfaces 53*a*, 57*a* during rotation of the drive shaft 16. This easily changes the orbiting radius of the balls 59 about axis L. Furthermore, the balls 59 have no directional restrictions and are thus easily installed during assembly of the compressor.

(6) The valve body 58 is also spherical. Thus, the valve body 58 is also easily installed.

(7) The valve body 58 and the balls 59 are identical spherical bodies. Thus, the valve body 58 and the balls 59 are interchangeable. This facilitates assembly of the compressor.

(Second Embodiment)

Figure 7:
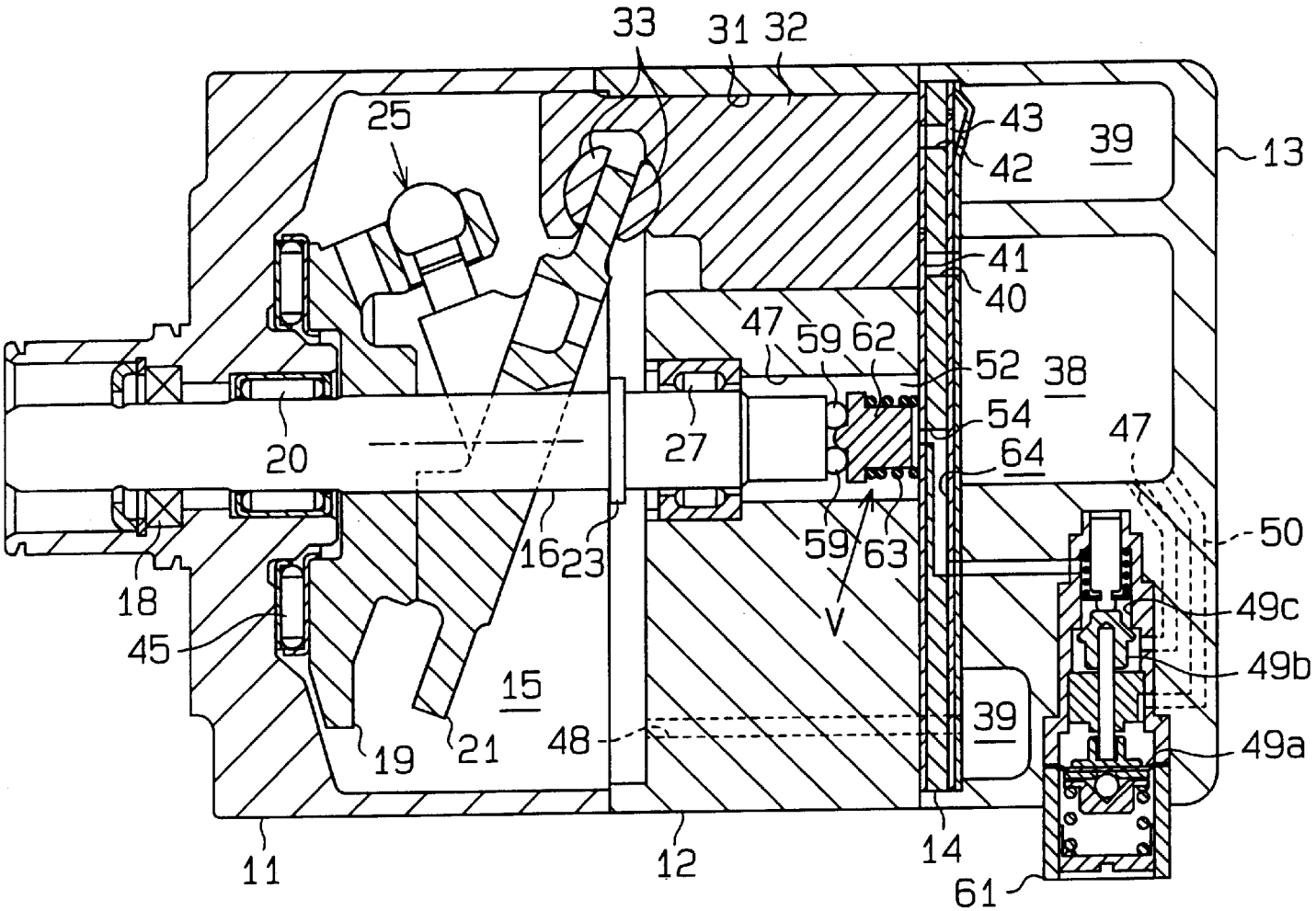
FIG. 7 is a cross-sectional view showing a compressor according to a second embodiment of the present invention.
Figure 8:
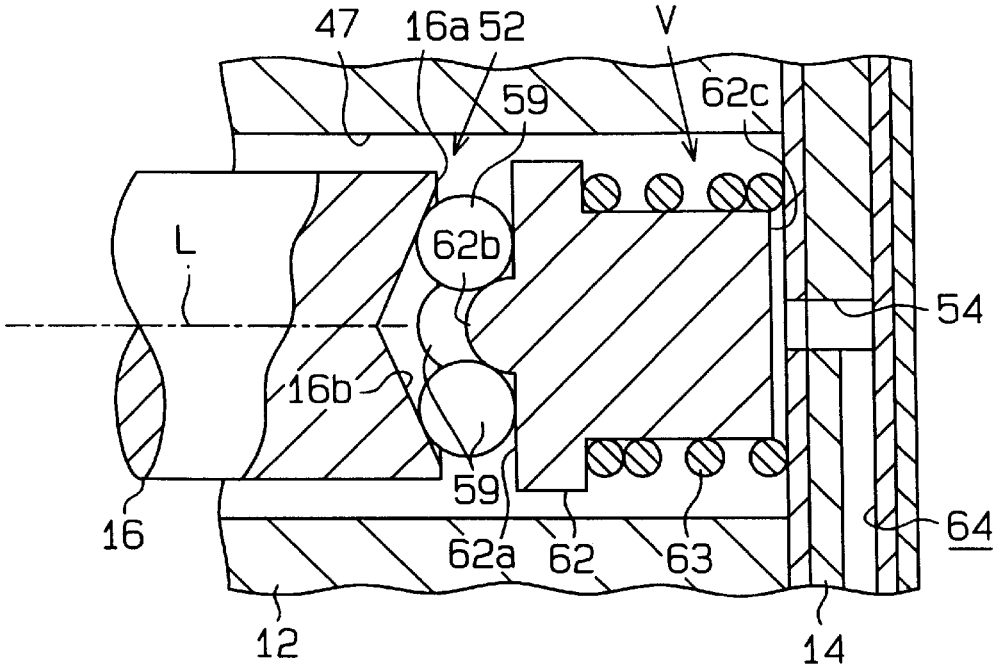
FIG. 8 is a partial enlarged cross-sectional view showing the vicinity of a valve of the compressor of FIG. 7.
Figure 9:
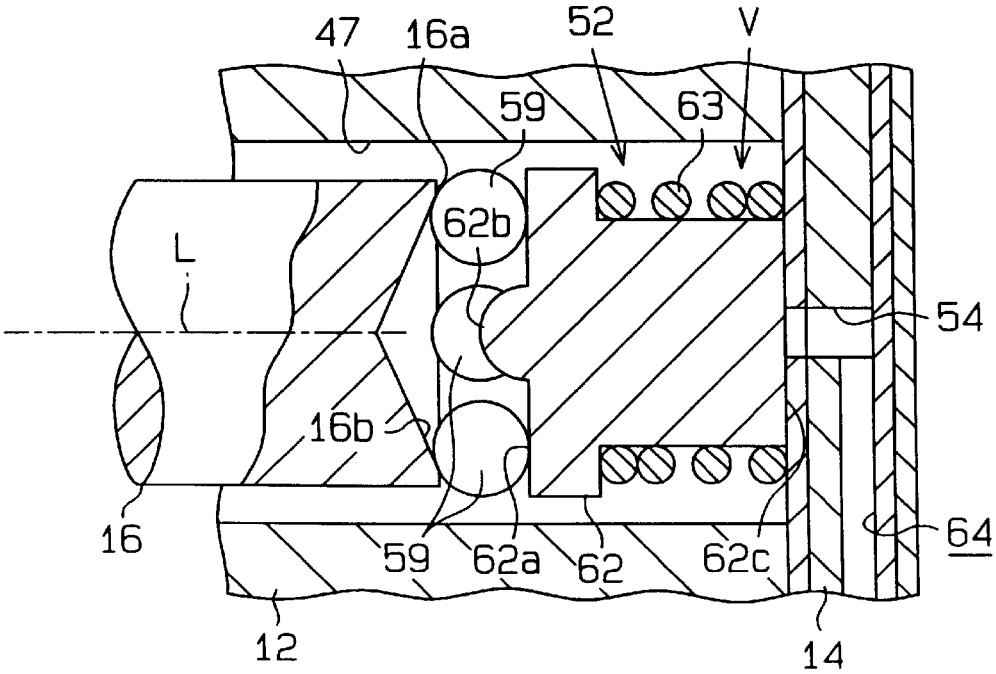
FIG. 9 is a partial enlarged cross-sectional view showing the operation of the valve.

A second embodiment according to the present invention will now be described with reference to FIGS. 7 to 9. As shown in FIG. 7, a displacement control valve 61 is arranged in a bleeding passage 47. The control valve 61 increases the size of the bleeding passage 47 when the suction pressure becomes higher than a predetermined value. Thus, gas in the crank chamber 15 is released into the suction chamber 38 through the bleeding passage 47. The decrease in the pressure of the crank chamber 15 moves the swash plate 21 toward the maximum inclination position and lengthens the stroke of the pistons 32. If the suction pressure becomes lower than the predetermined value, the control valve 61 decreases the size of the bleeding passage 47. Thus, the refrigerant gas in the discharge chamber 39 is drawn into the crank chamber 15 through the adjustment passage 48. This increases the pressure of the crank chamber 15, moves the swash plate 21 toward the minimum inclination position, and shortens the stroke of the pistons 32.

The bleeding passage 47 also serves as a pressure releasing passage in which the valve V is arranged. As shown in FIG. 7, a valve chamber 52 is defined between the crank chamber 15 and the control valve 61 in the bleeding passage. Spaces formed in the radial bearing 27 communicate the crank chamber 15 with the valve chamber 52. The adjustment passage 48 extends through the cylinder block 12 to continuously permit the flow of gas from the discharge chamber 39 to the crank chamber 15.

A valve body 62, which serves as a fixed guide, is accommodated in the valve chamber 52 and supported by a coil spring 63, which serves as an urging means. The valve body 62 moves axially to selectively open and close a valve chamber port 54. The force of the coil spring 63 urges the valve body 62 to a position spaced from the valve chamber port 54. The valve chamber 52 is connected to the suction chamber 38 through the valve chamber port 54, and a conduit 64, which extends through the valve plate 14 and the rear housing 13.

The valve body 62 has a fixed guide surface 62*a*, which is annular and defined on the surface facing the rear end face 16*a* of the drive shaft 16. A spherical projection 62*b*, coaxial with axis L, projects from the front side of the valve body 62. A seal surface 62*c* is defined on the rear side of the valve body 62.

A conical rotated guide surface 16*b*, facing the fixed guide surface 62*a*, is defined on the rear end face 16*a* of the drive shaft 16 about axis L. The drive shaft 16 serves as a rotated guide. The force of the coil spring 63 holds the balls 59 between the fixed guide surface 62*a* and the rotated guide surface 16*b*. The conical rotated guide surface 16*b* guides the balls 59 toward the axis L until they contact the spherical projection 62*b*.

During operation of the compressor, the rotation of the drive shaft 16 applies centrifugal force to the balls 59 and increases the orbiting radius of the balls 59. As tho orbiting radius of the balls 59 increase and causes the balls 59 to move outward along the conical rotated guide surface 16*b*, the balls 59 push the valve body 62 toward the valve chamber port 54 against the force of the spring 63.

The valve V is arranged such that it opens the bleeding passage 47 under normal situations. Thus, differential pressure does not act on the valve body 62. Accordingly, the valve V is closed when the drive shaft rotating speed N reaches a fixed limit value Nc independently of the differential pressure.

When the vehicle is accelerated such that the rotating speed N exceeds the fixed limit value Nc, the seal surface 62*c* of the valve body 62 abuts against the valve plate 14 and closes the valve chamber port 54. As the valve body 62 closes the valve chamber port 54, gas from the crank chamber 15 stops escaping into the suction chamber 38. Accordingly, the high-pressure refrigerant gas in the discharge chamber 39 continues to enter the crank chamber 15 through the adjustment passage 48, which increases the pressure of the crank chamber 15 and decreases the displacement. As a result, the load of the compressor decreases. This avoids early deterioration of compressor components caused by friction and improves the driving comfort of the vehicle.

If the rotating speed N falls below the limit value Nc when the valve chamber port 54 is closed, the centrifugal force applied to the balls 59 weakens and decreases the orbiting radius of the balls 59. Thus, the force of the spring 63 moves the valve body 62 toward the drive shaft 16 and opens the valve chamber port 54. In this state, the displacement is varied in accordance with the size of the bleeding passage 41 opened by the control valve 61.

In addition to advantages (1) to (3) of the first embodiment, the second embodiment has the advantages described below.

(1) In this embodiment, the valve V is arranged in the bleeding passage 47, which connects the crank chamber 15 to the suction chamber 38. Thus, an exclusive pressure releasing passage is not necessary. This simplifies the structure of the compressor. In other words, the valve body 62 opens the valve chamber port 54 under normal conditions (i.e., when the rotating speed N of the drive shaft 16 is lower than the limit value Nc) and does not interfere with the adjustment of the bleeding passage 47 by the control valve 61.

(2) When the balls 59 roll and rotate about axis L, the valve body 62 follows the balls 59 and rotates. The spring 63 permits rotation of the valve body 62. However, when the valve body 62 opens the valve chamber port 54, as shown in FIG. 8, the valve body 62 is spaced from the valve plate 14. Thus, there is no resistance, which would interfere with smooth rotation of the drive shaft 16, between the valve body 62 and the valve plate 14. In other words, the valve body 62 and the valve plate 14 do not contact each other during normal operation, which allows the drive shaft 16 to rotate smoothly. This leads to smooth compression motion and maintains driving comfort.

(3) The seal surface 62*c* of the valve body 62 abuts against the valve plate 14 to close the valve chamber port 54. In this state, the valve chamber port 54 is closed to prevent leakage of refrigerant gas. This decreases displacement as desired.

(4) The valve body 62 serves as the fixed guide. This decreases the number of components and simplifies the structure of the compressor.

(5) The spherical projection of the valve body 62 restricts movement of the balls 59 toward axis L when the rotating speed N of the drive shaft 16 is low.

(6) The drive shaft 16 includes the rotated guide surface 16*b*, which is defined on the rear end face 16*a* of the drive shaft 16. Thus, coupling components for coupling the rotated guide to the drive shaft 16 are not required. This further simplifies the structure of the compressor.

(Third Embodiment)

Figure 10:
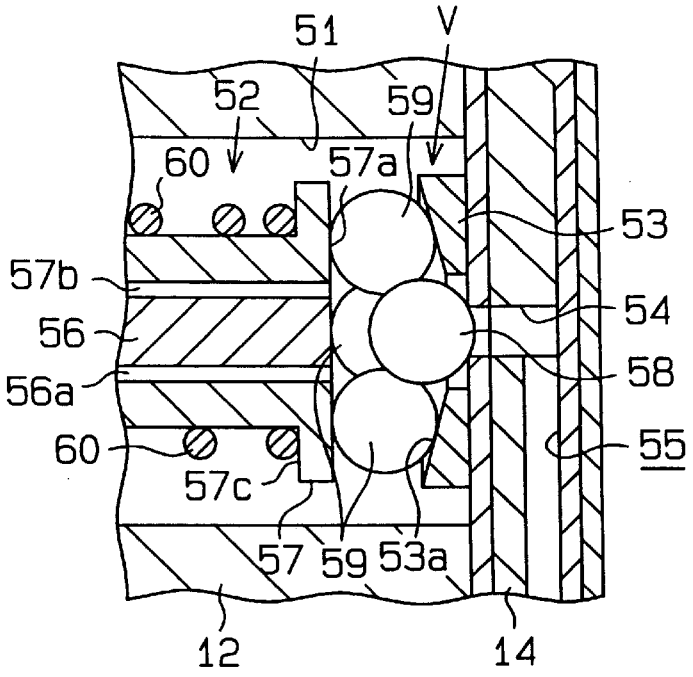
FIG. 10 is a partial cross-sectional view showing the vicinity of a valve employed in a compressor according to a third embodiment of the present invention.

A third embodiment according to the present invention will now be described with reference to FIG. 10. In this embodiment, the rotated guide surface 57*a* is flat, while the fixed guide surface 53*a* of the seat 53 is conical. The rotated guide surface 57*a* moves in a direction perpendicular to the axis L when the drive shaft 16 vibrates slightly during rotation. Thus, the balls 59 keep orbiting about the same center point (axis L). Accordingly, accurate orbiting of the balls 59 about axis L stabilizes the opening and closing of the valve chamber port 54 with the valve body 58.

(Fourth Embodiment)

Figure 11:
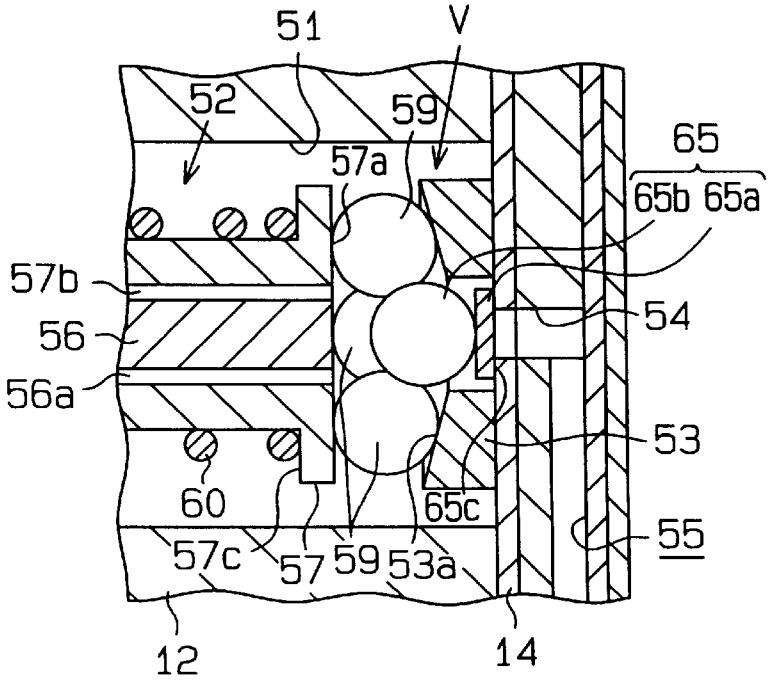
FIG. 11 is a partial cross-sectional view showing the vicinity of a valve employed in a compressor according to a fourth embodiment of the present invention.

A fourth embodiment according to the present invention will now be described with reference to FIG. 11. In this embodiment, a two part valve 65 is used instead of the single valve body 58. The valve 65 includes a plate 65*a*, which opens and closes the valve port chamber 54, and a sphere 65*b*, which is arranged between the plate 65*a* and the balls 59. The plate 65*a* has a seal surface 65*c*, which contacts the valve plate 14 to close the valve chamber port 54.

The fourth embodiment has the advantages described below.

(1) When the rotation of the drive shaft 16 orbits the balls 59 about axis L with the valve chamber port 54 closed by the valve body 65, the sphere 65*b* follows the orbiting of the balls 59 and rotates about axis L. However, the sphere 65*b* and the circular plate 65*a* are in point contact with each other. Thus, the plate 65*a* does not follow the rotation of the sphere 65*b*. Accordingly, forces, which hinder smooth rotation of the drive shaft 16, are not produced between the circular plate 65*a* and the valve plate 14.

(2) The seal surface 65*c* of the circular plate 65 abuts against the valve plate 14 and closes the valve chamber port 54. Therefore, the valve chamber port 54 is securely closed under normal operating conditions (when the point representing the rotating speed N of the drive shaft 16 and the second differential pressure ΔP2 is lower than the limit value curve 110, shown in FIG. 6). This prevents gas from the discharge chamber from escaping into the crank chamber 15 through the pressurizing passage 55. Therefore, the displacement is accurately controlled by the control valve 49.

(Fifth Embodiment)

Figure 12:
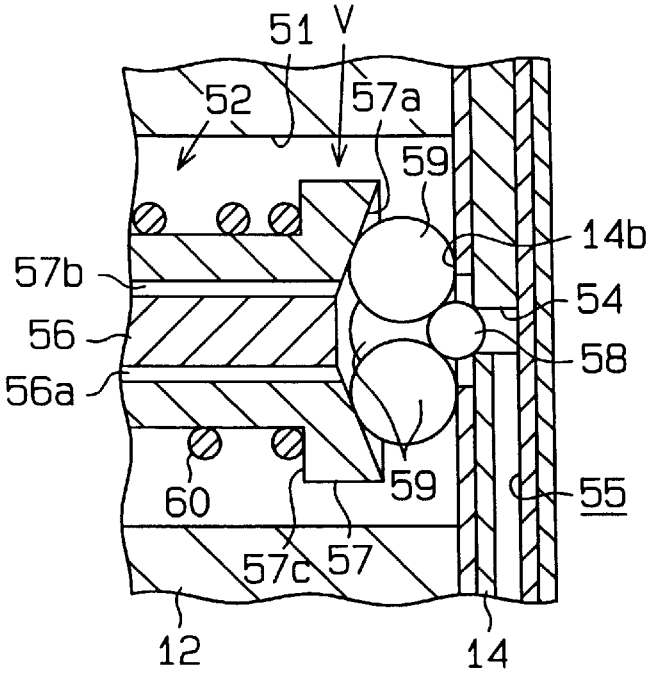
FIG. 12 is a partial cross-sectional view showing the vicinity of a valve employed in a compressor according to a fifth embodiment of the present invention.

A fifth embodiment according to the present invention will now be described with reference to FIG. 12. In this embodiment, the size (diameter) of the valve body 58 differs from that of the orbiting balls 59. Furthermore, the seat 53 is eliminated in this embodiment. A valve chamber port 54 is defined in the valve plate 14 at a position corresponding to the valve chamber 52. A fixed guide surface 14*b* is defined about the valve chamber port 54 on the valve plate 14. In other words, the valve plate 14 serves as a fixed guide. This decreases the number of compressor components and simplifies the structure of the compressor.

(Sixth Embodiment)

Figure 13:
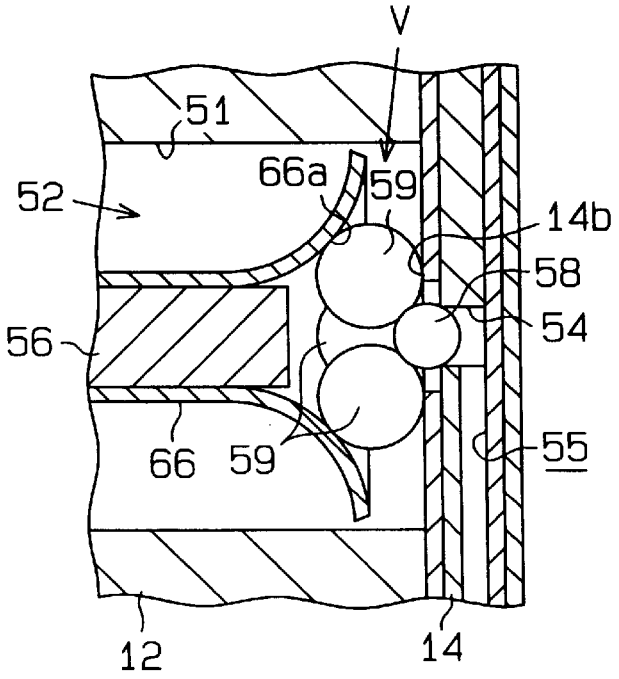
FIG. 13 is a partial cross-sectional view showing the vicinity of a valve employed in a compressor according to a sixth embodiment of the present invention.
Figure 14:
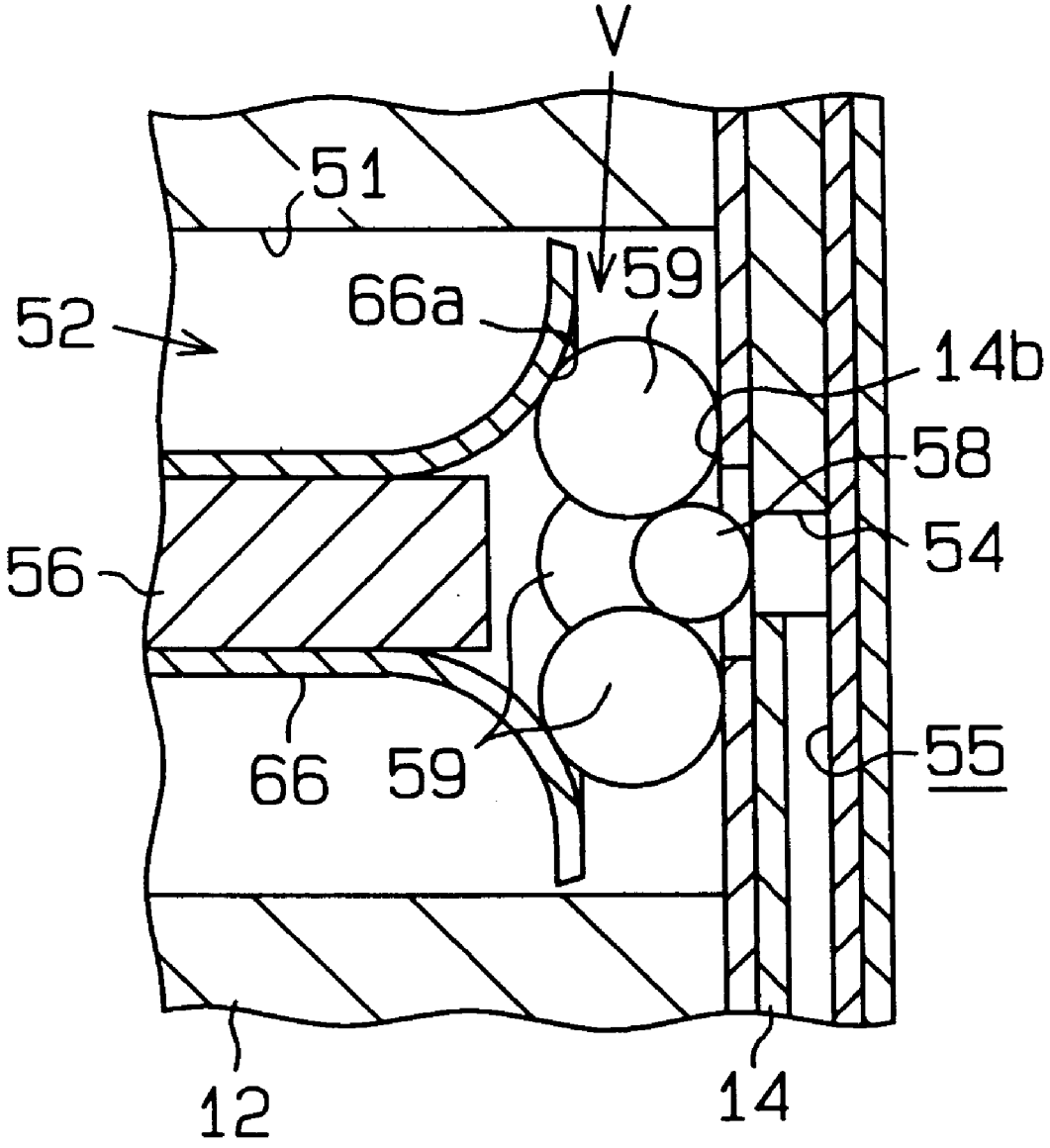
FIG. 14 is a partial cross-sectional view showing the operation of the valve.

A sixth embodiment according to the present invention will now be described with reference to FIGS. 13 and 14. In this embodiment, the valve plate 14 serves as a fixed guide as in the fifth embodiment. The rotated guide 66 is generally conical (trumpet-shaped) and opens toward the valve plate 14. The rotated guide 66 is fixed to the connecting rod 56. An annular guide surface 66*a* is defined on the conical inner surface of the rotated guide 66 about the axis L facing the valve plate 14. The rotated guide 66 is made of a synthetic resin and is elastic. Elastic deformation of the rotated guide 66 increases the diameter of the rotated guide 66. Alternatively, the rotated guide 66 may be made of a thin metal material.

The annular guide surface 66*a* of the rotated guide 66 is pressed against the balls 59. Thus, the elastic deformation of the rotated guide 66 occurs. This holds the balls 59 between the fixed guide surface 41*b* and the annular guide surface 66*a*. The annular guide surface 66*a* forces the balls 59 toward axis L until the balls 59 contact the valve body 58. This causes valve body 58 to abut against valve plate 14 and close the valve chamber port 54. In other words, the rotated guide 66 serves as an urging member in this embodiment.

During acceleration of the vehicle, if the rotating speed N of the drive shaft 16 exceeds the limit value curve 110, the large centrifugal force applied to the balls 59 increases the orbiting diameter of the ball 59. This deforms and widens the rear side of the rotated guide 66 to separate the annular guide surface 66a from the guide surface 14*b*. Therefore, the force applied to the valve body 58 in the direction opening the valve chamber port 54 becomes greater than the force applied to the valve body 58 in the direction closing the valve chamber port 54. This moves the valve body 58 toward the drive shaft 16 and opens the valve chamber port 54.

During normal operation of the compressor (i.e., when the rotating speed N is lower than the limit value curve 110), if the second differential pressure ΔP2 exceeds the limit value curve 110, the force applied to the valve body 58 in the direction that opens the valve chamber port 54 becomes greater than the force applied to the valve body 58 in the direction that closes the valve chamber port 54. This forces the valve body 58 toward the drive shaft 16 and opens the valve chamber port 54.

If the point representing the rotating speed N and the second differential pressure ΔP2 falls below the limit value curve 110 when the valve chamber port 54 is opened, the force applied to the valve body 58 in the direction opening the valve chamber port 54 becomes lower than the force applied to the valve body 58 in the direction closing the valve chamber port 54. Thus, the diameter of the rear side of the rotated guide 66 decreases causing the guide 66 to return to its original position. As a result, the distance between the guide surfaces 66*a*, 14*b* decreases. This decreases the orbiting radius of the balls 59 and closes the valve chamber port 54 with the valve body 58.

In this embodiment, the elastic rotated guide 66 also serves as an urging member. This simplifies the structure of the compressor.

(Seventh Embodiment)

A seventh embodiment according to the present invention will now be described with reference to FIGS. 15 and 16. In this embodiment, the rotated guide 57 is similar to that of the first embodiment. A fixed guide is defined on the valve plate 14 in the same manner as the fifth embodiment. An accommodating chamber 68, which is similar to the valve chamber 52 of the second embodiment, is located in the bleeding passage 47 between the displacement control valve 61 and the suction chamber 38. A suction chamber port 69, which is coaxial to the shaft axis L, extends through the valve plate 14. The suction chamber 38 and the accommodation chamber 68 are connected to each other through the suction chamber port 69.

The valve body 67 includes a main portion 67*a*, which is arranged in the suction chamber 38, a contact portion 67*b*, which is arranged in the accommodating chamber 68, and a rod 67*c*, which extends through the suction chamber port 69 and integrally connects the main portion 67*a* to the contact portion 67*b*. The main portion 67*a* is spherical. The contact portion 67*b* has a conical surface 67*d*, the diameter of which decreases at locations closer to the drive shaft 16. A coil spring 70 is arranged in the suction chamber 38 to urge the main portion 67*a* in a direction closing the suction chamber port 69. Contact between the conical surface 67*d* and the orbiting balls 59 restricts movement of the contact portion 67 toward the drive shaft 16. Thus, the main portion 67*a* keeps the suction chamber port 69 opened under normal conditions, as shown in FIG. 15.

Figure 15:
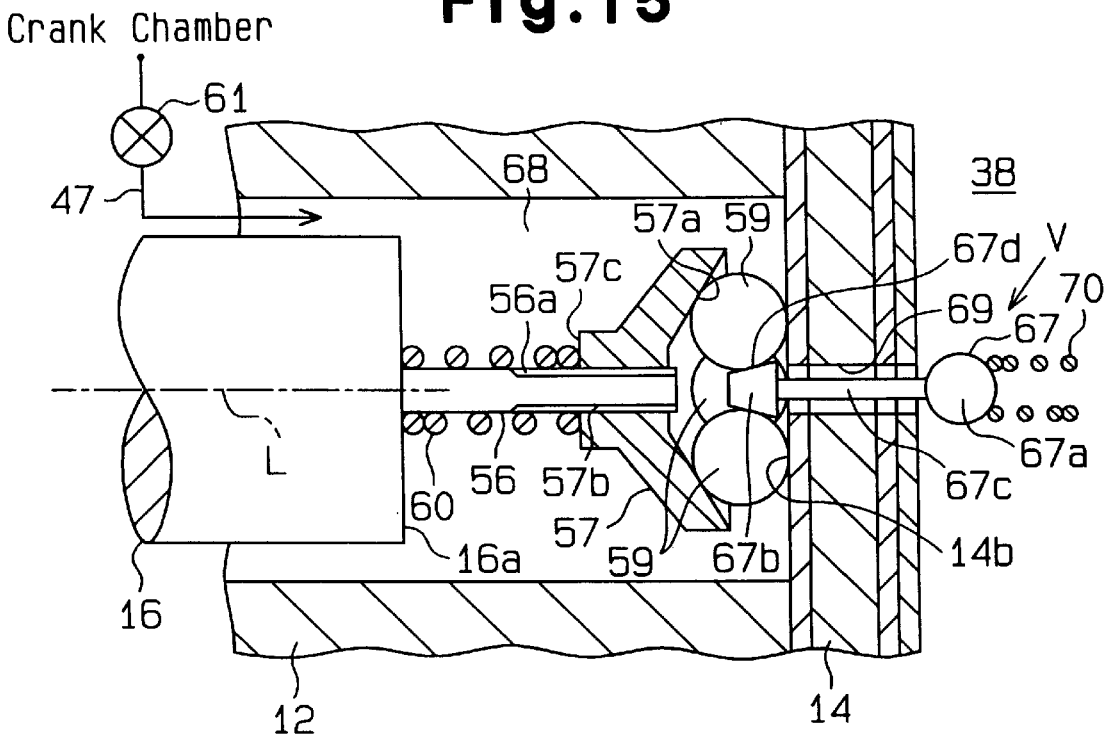
FIG. 15 is a partial cross-sectional view showing the vicinity of a valve employed in a compressor according to a seventh embodiment of the present invention.
Figure 16:
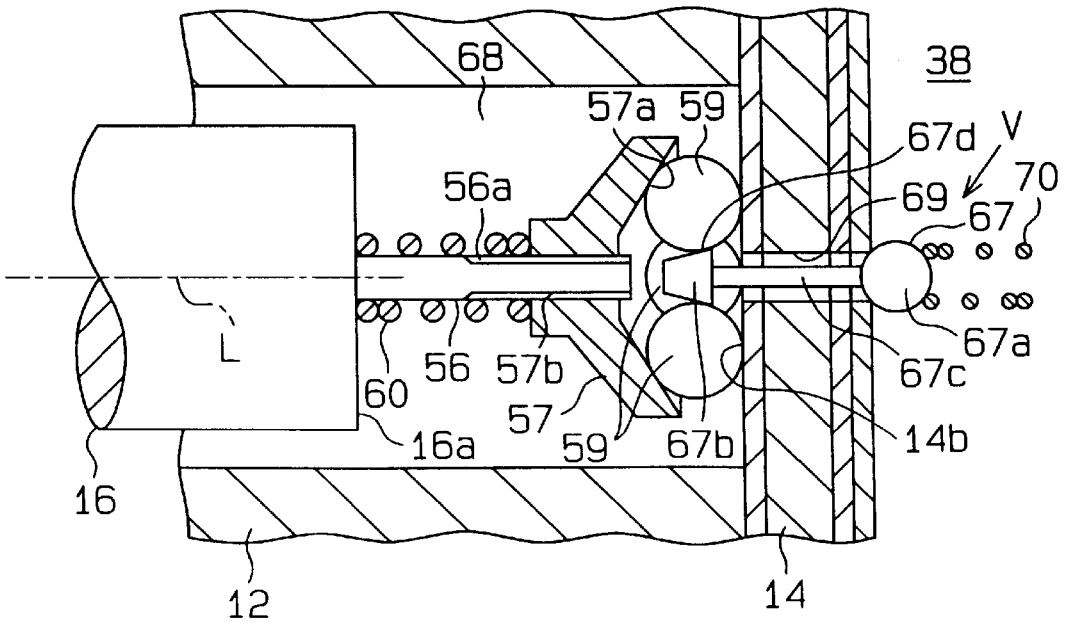
FIG. 16 is a partial enlarged cross-sectional view showing the operation of the valve.

If the rotating speed N of the drive shaft 16 exceeds a fixed limit value Nc in the state of FIG. 15, the centrifugal force applied to the balls 59 moves the balls 59 in a direction increasing the orbiting radius of the balls 59. This causes the balls 59 to permit movement of the rotated guide 57 toward the drive shaft 16 against the force of the spring 60 and separates the guide surface 57*a* from the guide surface 14*b*. Consequently, the force of the spring 70 moves the main and contact portions 61*a*, 6*b* of the valve body 61 toward the drive shaft 16 until the main portion 67*a* abuts against the valve plate 14 and closes the suction chamber port 69, as shown in FIG. 16.

If the rotating speed N of the drive shaft 16 falls below the fixed limit value Nc when the suction chamber port 69 is closed, the centrifugal force applied to the balls 59 weakens. Accordingly, the force of the spring 60 moves the rotated guide 57 toward the valve plate 14 such that the guide surface 57*a* approaches the guide surface 14*b*. This decreases the orbiting radius of the balls 59. The decreased orbiting radius moves the contact portion 67*b* toward the valve plate 14. This moves the main portion 67*a* against the force of the spring 70 and opens the suction chamber port 69.

Advantages (1) to (3) of the first embodiment and advantages (1) and (2) of the second embodiment are also obtained in the seventh embodiment.

(Eighth Embodiment)

Figure 17:
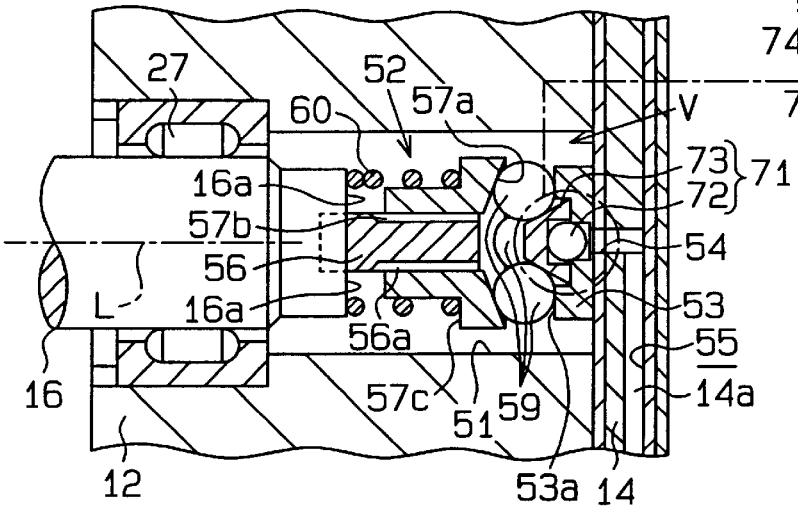
FIG. 17 is a partial cross-sectional view showing the vicinity of a valve employed in a compressor according to an eighth embodiment of the present invention.
Figure 17A:
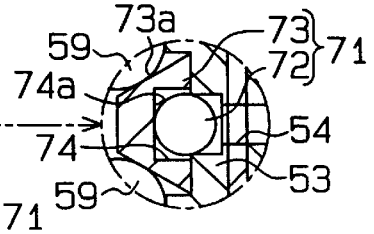
FIG. 17A is a partial enlarged cross-sectional view showing the valve.
Figure 18:
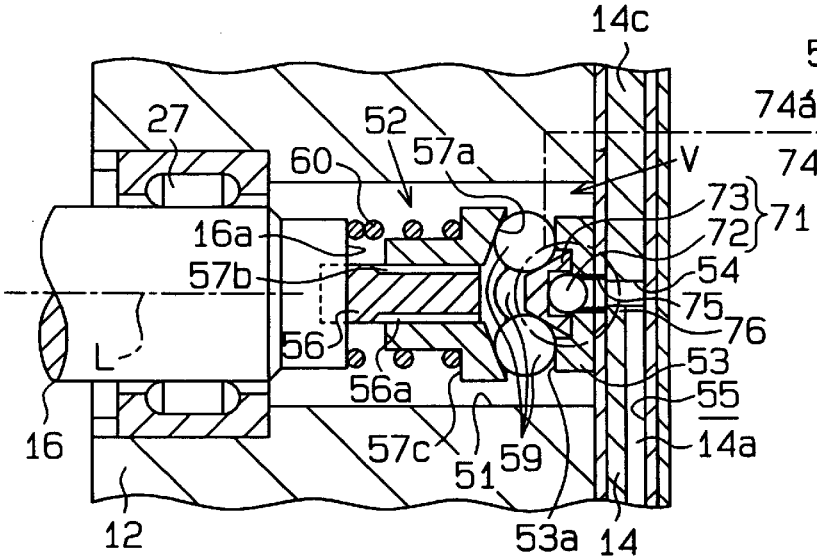
FIG. 18 is a partial cross-sectional view showing the vicinity of a valve employed in a compressor according to a ninth embodiment of the present invention.
Figure 18A:
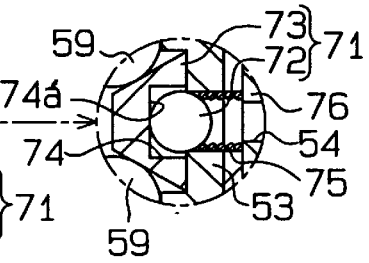
FIG. 18A is a partial enlarged cross-sectional view showing the valve.
Figure 19:
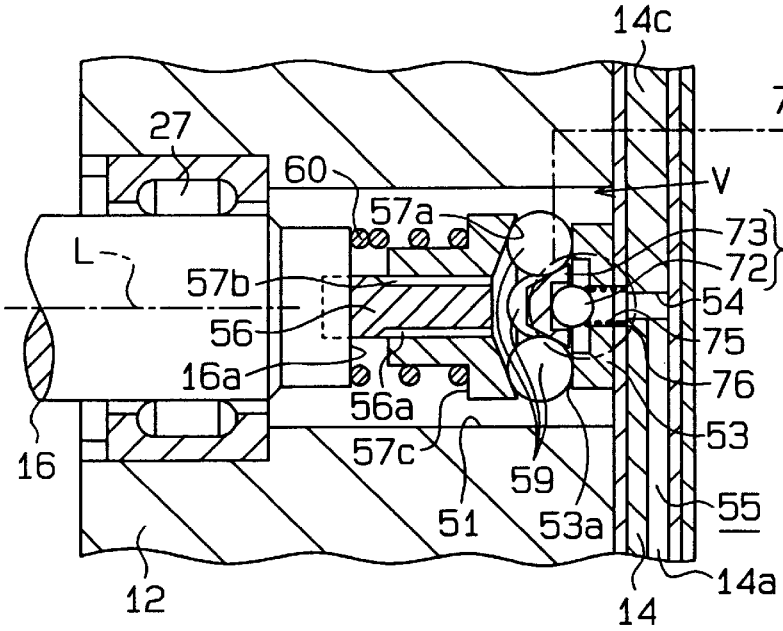
FIG. 19 is a partial enlarged cross-sectional view showing the operation of the valve.
Figure 19A:
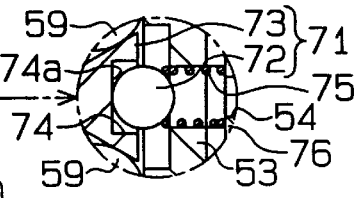
FIG. 19A is a partial enlarged cross-sectional view showing the valve.

An eighth embodiment according to the present invention will now be described with reference to FIG. 17. As shown in FIG. 17 and FIG. 17A, a valve body 71 includes a sphere 72 and a spacer 73, which is arranged between the sphere 72 and the orbiting balls 59. The diameter of the sphere 72 is smaller than that of the balls 59. The spacer 73 is conical. That is, the diameter of the spacer 73 decreases at positions closer to the drive shaft 16. The balls 59 contact the conical surface 73*a*. A recess 74 is formed in the rear central portion of the spacer 73. The recess 14 has a bottom surface 74*a* extending perpendicular to the axis L. The sphere 72 is loosely fit in the recess 74 such that the sphere 72 is in point contact with the bottom surface 74*a* and such that a portion of the sphere 72 projects from the recess 74. The projected portion of the sphere 72 is used to open and close the valve chamber port 54.

In addition to advantages (1) to (5) of the first embodiment, the eighth embodiment has the advantages described below.

(1) The recess 74 may be eliminated from the spacer 73 and be replaced by a spherical projection located at the rear central portion of the valve chamber port 54. However, the spherical projection must be machined accurately to securely close the valve chamber port 54. If refrigerant gas leaks through the valve chamber port 54, displacement control by the control valve 49 becomes inaccurate.

However, in this embodiment, the sphere 72 and the spacer 73 of the valve body 71 are formed separately. Thus, the sphere 72 can be formed more easily with accurate dimensions. This guarantees the closing of the valve chamber port 54. The spacer 73 permits the employment of a smaller sphere 72. In other words, the spacer 73 permits the small sphere 74 to close the valve chamber port 54 with only slight movement of the balls 59 toward the axis L.

(2) The sphere 72 is loosely fit in the recess 74. This permits movement of the spacer 73 in a direction perpendicular to axis L. Thus, slight vibrations of the drive shaft 16, the balls 59, and the spacer 13 that are produced during normal operation of the compressor are absorbed by the movement of the spacer 73. This prevents the application of biased load to the valve seat 53. Accordingly, damage caused by biased load on the seat 53 is avoided. This prevents leakage of refrigerant gas through the valve chamber port 54 when the port 54 is closed by the sphere 72 and controls displacement accurately with the control valve 49.

(3) During normal operation of the compressor, the spacer 73 follows the orbiting of the balls 59 and rotates about axis L. However, the sphere 72 is accommodated in the recess 74 with play. In addition, the sphere 72 and the bottom surface 74*a* of the recess 74 are in point contact with each other. Thus, the sphere 72 does not follow the rotation of the spacer 73. This prevents the production of a force that hinders smooth rotation of the drive shaft 16 at the portion of contact between the sphere 72 and the valve seat 53.

(Ninth Embodiment)

A ninth embodiment according to the present invention will now be described with reference to FIGS. 18, 18A, 19 and 19A. This embodiment is similar to the eighth embodiment but differs in that a coil spring 15, which serves as a second urging member, is employed in addition to the spring 60, which serves as a first urging member. The spring 75 urges the valve body 71 in a direction opening the valve chamber port 54.

A spring seat 76 is formed on the valve plate 14 in the valve chamber port 54. The spring 75 is arranged between the sphere 72 and the spring seat 76 to urge the spacer 73 toward the balls 59.

The urging force of the spring 60 is increased in comparison to that of the eighth embodiment to offset the force of the spring 60. Thus, the characteristics of the valve V of the ninth embodiment are the same as those of the eighth embodiment.

In addition to the advantages of the eighth embodiment, the ninth embodiment has the advantages described below.

(1) Some of the refrigerant gas, which starts to pass through the valve chamber 52 immediately after the valve body 71 opens the valve chamber port 54, may enter the space between the valve body 71 (the spacer 73) and the balls 59. This may temporarily increase the back pressure acting on the rear side of the valve body 71. In such state, the valve body 71 may move away from the balls 59 and decrease the opening size of the valve chamber port 54 until the valve body 71 closes the valve chamber port 54. Such opening and closing may occur repetitively. This would interfere with the flow of the high pressure refrigerant gas from the discharge chamber 39 to the crank chamber 15 and delay pressure increase in the crank chamber 15. As a result, decrease of the compressor displacement during displacement control may be delayed. In addition, the impact of the valve body 71 against the balls 59 and the valve seat 53 during the repetitive opening and closing of the valve chamber port 54 may produce vibrations and noise.

However, in this embodiment, the spring 75 urges the valve body 71 toward the balls 59. This prevents separation of the valve body 71 from the balls 59 even if the back pressure acting on the valve body 71 increases immediately after the valve body 71 opens the valve chamber port 54. Thus, the valve chamber port 54 remains open under such conditions. This readily decreases the displacement of the compressor and prevents the production of vibrations and noise.

(2) The valve body 71 includes the sphere 72 and the spacer 73. The sphere 72 is loosely fitted in the recess 74 of the spacer 73. Thus, some of the refrigerant gas, which starts to pass through the valve chamber 52 immediately after the valve body 71 opens the valve chamber port 54, may enter the recess 74. This would create back pressure, which may cause the sphere 72 to move away from the bottom surface 74*a* of the recess 74.

However, the spring 75 urges the sphere 72 toward the balls 59. This keeps the sphere 72 in contact with the bottom surface 74*a* of the recess 74 even if the back pressure acts on the sphere 72 in the recess 74. Thus, the displacement of the compressor decreases readily during displacement control. Furthermore, the production of vibrations and noise is prevented.

(Tenth Embodiment)

Figure 20:
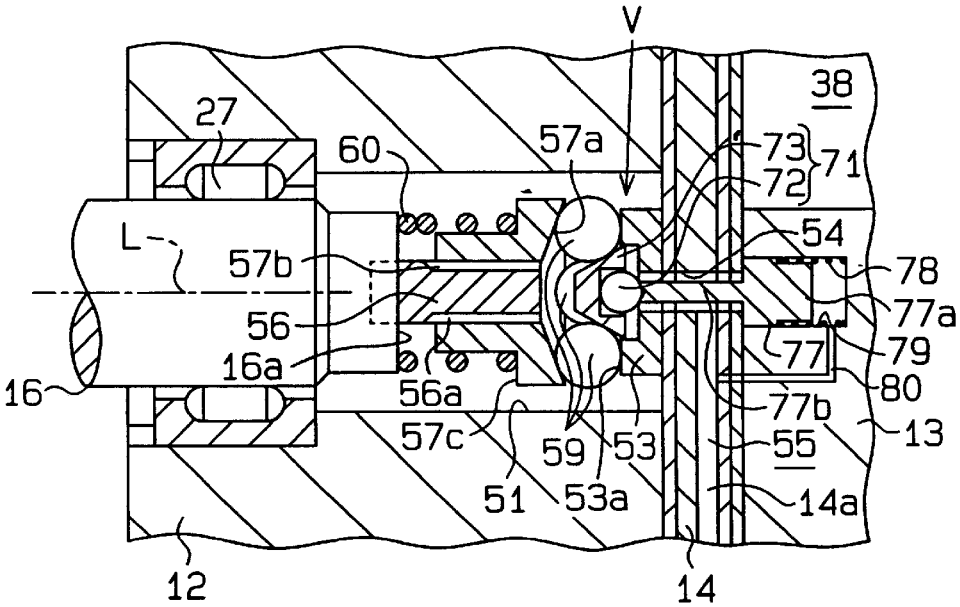
FIG. 20 is a partial cross-sectional view showing the vicinity of a valve employed in a compressor according to an tenth embodiment of the present invention.

A tenth embodiment according to the present invention will now be described with reference to FIG. 20. This embodiment is similar to the ninth embodiment but has a different second urging member. The second urging member includes a rod 17, which contacts the sphere 72, and a spring 78 for urging the sphere 72 by means of the rod 77 in a direction opening the valve chamber port 54.

A rod guide chamber 79 is housed in the rear housing 13 in alignment with the valve chamber port 54. The rod 77 includes a guide 77*a*, which is slidably accommodated in the rod guide chamber 79, and an actuator 77*b*, which is formed integrally with the guide 77*b*. The spring 78 is accommodated in the rod guide chamber 79. The actuator 77*b* projects from the rod guide chamber 79 into the valve chamber port 54 and contacts the sphere 72. The end of the actuation portion 77*b*, which contacts the sphere 72, is conical.

Accordingly, the spring 78 urges the valve body 71 toward the balls 59 by means of the guide 77*a* and the actuation portion 77*b*. A release passage 80 connects the pressurizing passage 55 and the rod guide chamber 79 to release the pressure applied to the front and rear portions of the guide 71*a*.

The tenth embodiment has the same advantages as the ninth embodiment. In addition, the spring 78 urges the valve body 71 by means of the rod 77. Thus, there is no direct contact between the spring 78 and the valve body 71. Accordingly, the dimensions and position of the spring 78 can be determined with less restrictions. Furthermore, the urging of the valve body 71 along axis L is guaranteed regardless of the end of the spring 78 being uneven. Furthermore, the conical end of the actuator 77*b* stably holds the valve body 72.

(Eleventh Embodiment)

Figure 21:
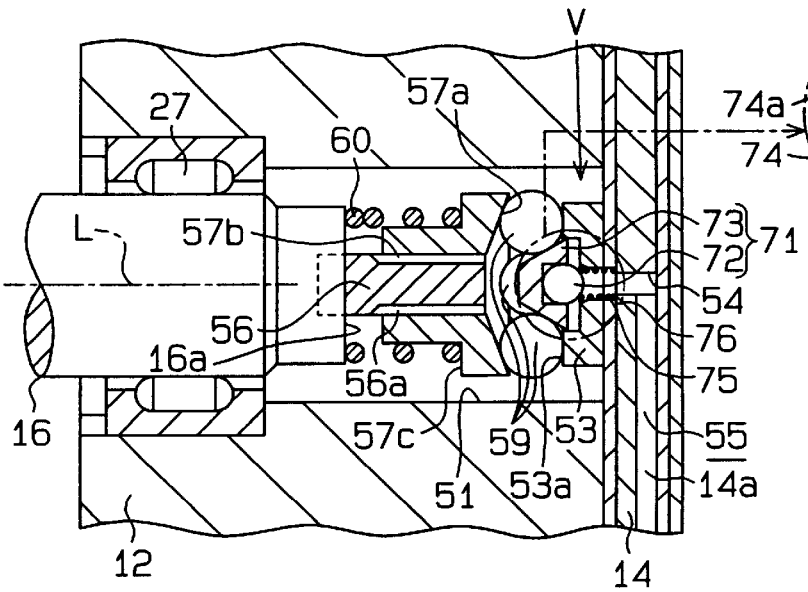
FIG. 21 is a partial cross-sectional view showing the vicinity of a valve employed in a compressor according to an eleventh embodiment of the present invention.
Figure 21A:
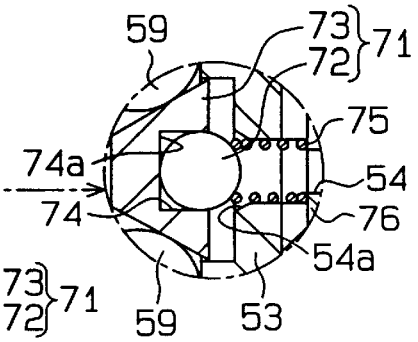
FIG. 21A is a partial enlarged cross-sectional view showing the valve.
Figure 22:
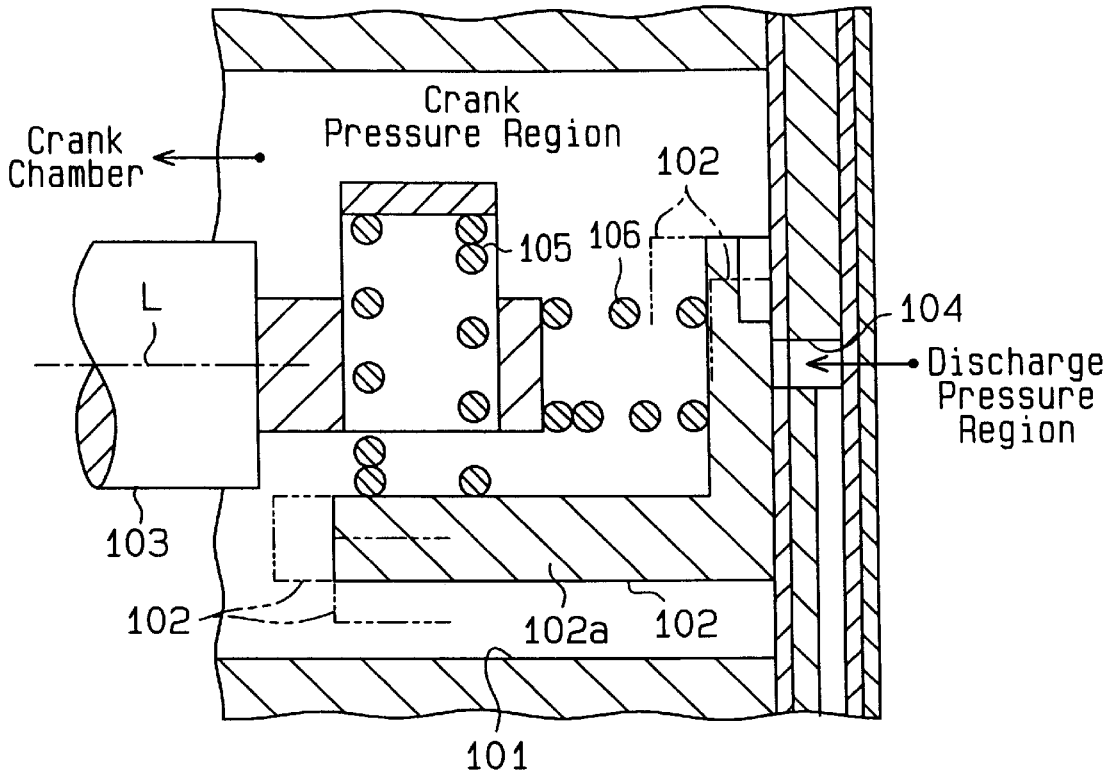
Fig.22 (Prior Art)
FIG. 22 is a partial cross-sectional view showing the vicinity of a displacement shifting mechanism in a prior art compressor.
Figure 23:
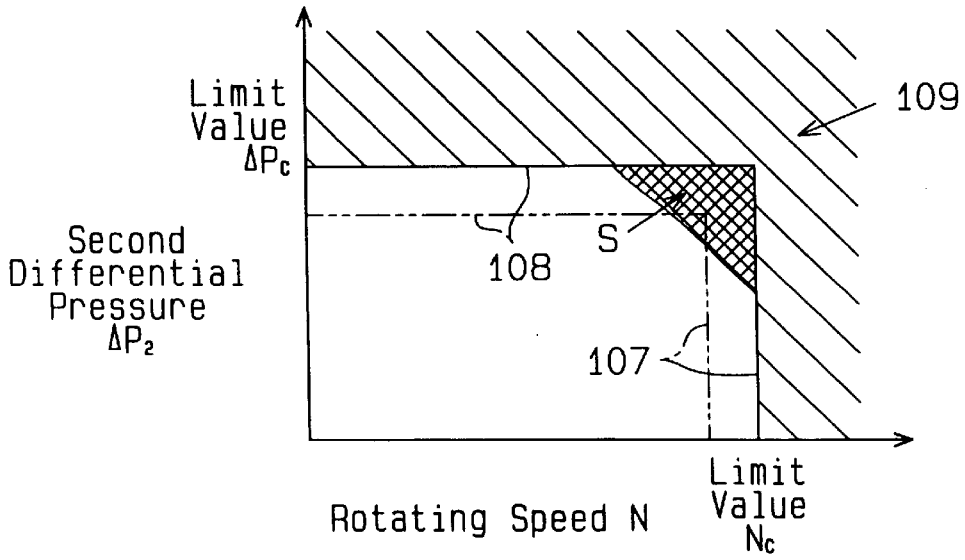
Fig.23 (Prior Art)
FIG. 23 is a graph showing the characteristics of the displacement shifting mechanism of FIG. 22.

An eleventh embodiment according to the present invention will now be described with reference to FIG. 21 and FIG. 21A. This embodiment is similar to the ninth embodiment but differs in that the sphere 72 is pressed into the recess 74 of the spacer 73. In other words, the sphere 72 and the spacer 73 are formed integrally. The sphere 72 seals the recess 74. Furthermore, the rim 54*a* of the valve chamber port 54, which is opened and closed by the valve body 71, is tapered.

The advantages of the eleventh embodiment will now be described.

(1) The sphere 72 and the spacer 73 are formed integrally with each other. The valve body 72 seals the recess 74. Accordingly, the refrigerant gas passing through the valve chamber 52 is prevented from entering the recess 74 immediately after the valve chamber port 54 is opened. Thus, only back pressure acting on the spacer 73 need be taken into consideration when selecting the spring. In other words, the springs 75, 60 can be compact.

(2) Due to the integral structure of the sphere 72 and the spacer 73, the sphere 72 vibrates slightly when the drive shaft 16, the rotated guide 57, and the orbiting balls vibrate during normal operation of the compressor. However, the edge corner of the rim 54*a* is tapered. This prevents the application of excessive biased load on the seat 53 when the sphere 72 vibrates. Accordingly, damages of the rim 54*a* is avoided. This guarantees the sealing of the valve chamber port 54 with the valve body 72 and accurately controls displacement with the control valve 49.

It should be apparent to those skilled in the art that the present invention may be embodied in many other specific forms without departing from the spirit or scope of the invention.

In each of the above embodiments, the opposing guide surfaces 53*a*, 57*a*, 14*b* (in the second embodiment 16*b*, 62*a*) may both be conical surfaces.

In the second and fifth embodiments, the rotated guide surface 16*b* (57*a* in the fifth embodiment) is conical. However, the fixed guide surface 62*a* (14*b*) of the valve body 62 may be conical instead such that its diameter increases at positions closer to the rotated guide surface 16*a* (57*a*).

In each of the above embodiments, the number of orbiting balls 59 may be more than or less than five.

In each of the above embodiments, the guides and the orbiting balls function as thrust ball bearings. However, the balls may be replaced by other types of orbiting elements, such as cylindrical needles or rollers that function as a roller-type bearing.

In the first, third to sixth, and eighth to eleventh embodiments, a displacement control valve may be arranged in the bleeding passage 47 to adjust the opened size of the bleeding passage 47 and change the pressure of the crank chamber 15.

In the second and seventh embodiments, the displacement control valve may be arranged in the adjustment passage 48 to adjust the opened size of the adjustment passage 48 and changed the pressure of the crank chamber 15.

In the eighth embodiment, the recess 74 may be eliminated from the spacer 73 and replaced by a spherical projection projecting from the rear central surface of the spacer 73 to open and close the valve chamber port 54. This reduces the number of components included in the valve body 71 and simplifies the structure of the compressor.

In the eleventh embodiment, the spring 75 may directly contact the spacer 73.

Therefore, the present examples and embodiments are to be considered as illustrative and not restrictive, and the invention is not to be limited to the details given herein, but may be modified within the scope and equivalence of the appended claims.

What is claimed is:

1. A variable displacement compressor comprising:

a drive shaft rotated about its axis;

a compression mechanism for drawing in and compressing gas in accordance with the rotation of the drive shaft;

a crank chamber housing part of the compression mechanism, wherein the gas flows into and out of the crank chamber to vary the displacement in accordance with the pressure of the gas in the crank chamber;

a suction pressure region, which is exposed to the pressure of gas drawn into the compressor by the compression mechanism;

a discharge pressure region, which is exposed to the pressure of gas compressed by the compression mechanism;

a communication passageway including at least a first passage or a second passage, wherein the first passage connects the discharge pressure region to the crank chamber, the first passage increasing the pressure of the crank chamber by permitting the flow of the gas from the discharge pressure region to the crank chamber, and wherein the second passage connects the crank chamber to the suction pressure region, the second passage decreasing the pressure of the crank chamber by permitting the flow of the gas from the crank chamber to the suction pressure region; and a valve arranged in either the first passage or the second passage, wherein the valve adjusts the opened area of the first or second passage to increase the pressure of the crank chamber when the rotating speed of the drive shaft exceeds a predetermined value, and wherein the valve includes:

a valve body for selectively opening and closing the first or second passage; and orbiting elements following the rotation of the drive shaft to orbit about the drive shaft and act on the valve body to selectively open and close the first or second passage, the orbiting elements maintaining substantially equal angular intervals between one another when orbiting about the drive shaft, each orbiting element having an orbiting radius defined by the path of the orbiting elements about the axis of the drive shaft, the orbiting elements moving radially to change the orbiting radius in accordance with the rotating speed of the drive shaft.

2. The variable displacement compressor according to claim 1, wherein the orbiting elements are spherical bodies.

3. The variable displacement compressor according to claim 1, wherein the valve body has a spherical surface, wherein the spherical surface of the valve body is in contact with each orbiting element.

4. The variable displacement compressor according to claim 1, wherein the valve further includes:

a first guide rotated integrally with the drive shaft, wherein the first guide has a surface to guide the orbiting of the orbiting elements;

a second guide having a surface facing the rotating guide surface to guide the orbiting elements; and an urging member for urging one of the first and second guides toward the other, the orbiting elements being arranged between the first and second guides and orbited about the axis of the first guide by the rotation of the first guide, the orbiting radius of the orbiting elements being changed in accordance with centrifugal force produced by the motion of the orbiting elements, which counters the force of the urging member.

5. The variable displacement compressor according to claim 4, wherein the second guide is movable in the axial direction of the first guide and functions as the valve body, and wherein the urging member urges the second guide toward the first guide.

6. The variable displacement compressor according to claim 4, wherein at least one of the first and second guide surfaces is substantially conical.

7. The variable displacement compressor according to claim 4, wherein part of the first or second passage extends axially through the second guide, and wherein the valve body is arranged between the first and second guides to close the part of the first or second passage extending through the second guide in accordance with the orbiting radius of the orbiting elements.

8. The variable displacement compressor according to claim 7, wherein the orbiting elements and the valve body are identical spherical bodies.

9. The variable displacement compressor according to claim 7, wherein the valve body includes a flat portion for selectively opening and closing the first or second passage, and a spherical portion arranged between the flat portion and the orbiting elements.

10. The variable displacement compressor according to claim 7, wherein one of the first guide and the second guide is made of an elastic material and also functions as the urging member.

11. The variable displacement compressor according to claim 7, wherein the valve body is arranged in the first passage, wherein movement by the valve body in a first direction increases the size of the first passage to increase the pressure of the crank chamber, the valve body functioning as a differential pressure valve for sensing the differential pressure between the discharge pressure region and the pressure of the crank chamber, wherein the valve opens the first passage at lower differential pressures as the rotating speed of the drive shaft increases.

12. The variable displacement compressor according to claim 11, wherein the valve body includes a sphere for selectively opening and closing the first passage and a spacer arranged between the sphere and the orbiting elements, the spacer having a recess for receiving the sphere.

13. The variable displacement compressor according to claim 10, wherein the sphere seals the recess such that the valve body is held integrally with the spacer.

14. The variable displacement compressor according to claim 12, wherein the first passage has a port selectively opened and closed by the sphere of the valve body, and wherein the port has a rim, the rim being tapered such that the inner diameter of the port increases at locations closer to the sphere.

15. The variable displacement compressor according to claim 12, wherein the valve includes a second urging member for urging the valve body in the first direction.

16. The variable displacement compressor according to claim 15, wherein the sphere is loosely fitted in the recess and receives the force of the second urging member for urging the valve body in the first direction.

17. The variable displacement compressor according to claim 15, wherein the second urging member includes a rod for contacting the valve body, and an urging body for urging the valve body by means of the rod.

18. A variable displacement compressor comprising:

a drive shaft rotated about its axis;

a compression mechanism for drawing in and compressing refrigerant gas in accordance with the rotation of the drive shaft;

a crank chamber housing part of the compression mechanism, wherein the refrigerant gas flows into and out of the crank chamber to vary displacement in accordance with the pressure of the refrigerant gas in the crank chamber;

a suction pressure region in which the pressure of the refrigerant gas drawn into the compressor by the compression mechanism acts;

a discharge pressure region in which the pressure of the refrigerant gas compressed by the compression mechanism and discharged out of the compressor acts;

a pressurizing passage for communicating the discharge pressure region and the crank chamber, wherein the pressurizing passage increases the pressure of the crank chamber by permitting the flow of the refrigerant gas from the discharge pressure region to the crank chamber; and a valve arranged in the pressurizing passage, wherein the valve adjusts the size of the pressurizing passage to increase the pressure of the crank chamber when the rotating speed of the drive shaft exceeds a predetermined value, and wherein the valve includes:

a valve body for selectively opening and closing the pressurizing passage; and orbiting elements following the rotation of the drive shaft to orbit about the drive shaft, the orbiting elements maintaining substantially equal angular intervals between one another when orbiting about the drive shaft and having an orbiting radius defined by the path of the orbiting elements about the axis of the drive shaft, the orbiting elements moving radially to change the orbiting radius in accordance with the rotating speed of the drive shaft, wherein the valve body functions as a differential pressure valve for sensing the differential pressure between the discharge pressure region and the pressure of the crank chamber, the valve opening the pressurizing passage at lower differential pressures as the rotating speed of the drive shaft increases.

19. The variable displacement compressor according to claim 18, wherein the valve further includes:

a first guide rotated integrally with the drive shaft, wherein the first guide has a surface to guide the orbiting of the orbiting elements;

a second guide having a surface facing the rotating guide surface to guide the orbiting elements; and an urging member for urging the first guide toward the second guide, the orbiting elements being arranged between the first and second guides to orbit about the axis of the first guide by the rotation of the first guide, the orbiting radius of the orbiting elements being changed in accordance with centrifugal force produced by the orbiting of the orbiting elements, which counters the urging force of the urging member.

20. A variable displacement compressor comprising:

a drive shaft rotated about its axis;

a compression mechanism for drawing in and compressing refrigerant gas in accordance with the rotation of the drive shaft;

a crank chamber housing part of the compression mechanism, wherein the refrigerant gas flows into and out of the crank chamber to vary the displacement in accordance with the pressure of the refrigerant gas in the crank chamber;

a suction pressure region, which is exposed to the pressure of the refrigerant gas drawn into the compressor by the compression mechanism;

a discharge pressure region, which is exposed to the pressure of the refrigerant gas compressed by the compression mechanism;

a pressure releasing passage for connecting the crank chamber and the suction pressure region, wherein the pressure releasing passage decreases the pressure of the crank chamber by permitting flow of the refrigerant gas from the crank chamber to the suction pressure region; and a valve arranged in the pressure releasing passage, wherein the valve adjusts the size of the pressure releasing passage to increase the pressure of the crank chamber when the rotating speed of the drive shaft exceeds a predetermined value, and wherein the valve includes:

a valve body for selectively opening and closing the pressure releasing passage; and orbiting elements following the rotation of the drive shaft to orbit about the drive shaft, the orbiting elements maintaining substantially equal angular intervals from one another when orbiting about the drive shaft and having an orbiting radius defined by the path of the orbiting elements about the axis of the drive shaft, the orbiting elements moving radially to change the orbiting radius in accordance with the rotating speed of the drive shaft;

a rotated guide rotated integrally with the drive shaft, wherein the rotated guide has a rotated guide surface to guide the motion of the orbiting elements;

an urging member for urging the valve body toward the rotated guide, the orbiting elements being arranged between the rotated guide surface and the valve body and orbited about the axis of the rotated guide by the rotation of the rotated guide, the valve body being moved in one direction to close the pressure releasing passage in accordance with centrifugal force produced by the orbiting of the orbiting elements, which counters the urging force of the urging member.

* * * * *

UNITED STATES PATENT AND TRADEMARK OFFICE

CERTIFICATE OF CORRECTION

PATENT NO. : 6,158,970 
DATED : December 12, 2000
INVENTOR(S) : Masaki Ota et al.

It is certified that error appears in the above-identified patent and that said Letters Patent is hereby corrected as shown below:

Title page,
References Cited, please add:

| | | |
|---|---|---|
| -- 2,292,805 | 8/11/42 | Tippen…….264/3 |
| 5,071,321 | 12/10/91 | Skinner, et al……...417/222 |
| 4,606,705 | 8/19/86 | Parekh……..417/222 |
| 4,285,311 | 8/25/81 | Iio……123/323 |

FOREIGN PATENT DOCUMENTS

| | | |
|---|---|---|
| EP 0 396 017 | 11/7/90 | EPO |
| DE 3603931 A1 | 8/14/86 | German --; |

Column 4,
Line 43, please change, “showing the valve.” to -- showing the valve; --;
Line 52, please change, “showing the valve.” to -- showing the valve; --;

Column 5,
Line 17, please change, “bearings 20 and 21.” to -- bearings 20 and 27. --;

Column 7,
Line 3, please change, “center point o1 is” to -- center point 01 is --;

Column 12,
Line 32, please change, “as tho orbiting” to -- as the orbiting --;

Column 15,
Line 51, please change, “portions 61a, 6b of the valve body 61 toward” to -- portions 67a, 67b of the valve body 67 toward --;

Column 16,
Line 11, please change “The recess 14 has a” to -- the recess 74 has a --;

UNITED STATES PATENT AND TRADEMARK OFFICE

CERTIFICATE OF CORRECTION

PATENT NO. : 6,158,970
DATED : December 12, 2000
INVENTOR(S) : Masaki Ota et al.

It is certified that error appears in the above-identified patent and that said Letters Patent is hereby corrected as shown below:

Column 18,
Line 4, please change, "of the guide 71a." to -- of the guide 77a. --.

Signed and Sealed this

Second Day of July, 2002

*Attest:*

*Attesting Officer*

JAMES E. ROGAN
*Director of the United States Patent and Trademark Office*